US005224590A

United States Patent [19]

Milianowicz et al.

[11] Patent Number: 5,224,590

[45] Date of Patent: Jul. 6, 1993

[54] CIRCUIT INTERRUPTER HAVING IMPROVED OPERATING MECHANISM

[75] Inventors: Stanislaw A. Milianowicz, Monroeville; Edward J. Klimek, Jeannette; William Q. Aglietti, Pittsburgh; Henry J. Remic, Jr., Salem Township, Westmoreland County; Mark L. Lotzmann, Irwin, all of Pa.

[73] Assignee: Westinghouse Electric Corp., Pittsburgh, Pa.

[21] Appl. No.: 788,707

[22] Filed: Nov. 6, 1991

[51] Int. Cl.[5] ..... H01H 5/00

[52] U.S. Cl. ..... 200/400; 200/401; 335/26; 335/27; 335/166; 335/167; 335/171; 74/2

[58] Field of Search ..... 200/400, 401; 335/166, 335/167, 171, 26, 27; 74/2

[56] References Cited

U.S. PATENT DOCUMENTS

| | | | |
|---|---|---|---|
| 3,174,021 | 3/1965 | Goodwin, Jr. | 200/400 |
| 3,207,879 | 9/1965 | Goodwin, Jr. | 200/400 |
| 3,590,192 | 6/1971 | Bould et al. | 200/400 |
| 3,684,848 | 8/1972 | Davies | 200/400 |
| 4,163,133 | 7/1979 | Bould . | |
| 4,240,300 | 12/1980 | Tanaka | 74/2 |
| 4,301,436 | 11/1981 | Castonguay et al. | 335/166 |
| 4,404,446 | 9/1983 | Maier et al. | 200/400 X |
| 4,475,021 | 10/1984 | Mochizuki et al. | 200/400 |
| 4,655,098 | 4/1987 | Marquardt et al. | 200/400 X |
| 4,742,200 | 5/1988 | Marquardt et al. | 74/200 X |
| 4,750,375 | 6/1988 | Godesa | 74/2 |
| 4,845,324 | 7/1989 | Martin et al. | 200/400 |
| 5,003,139 | 3/1991 | Edds et al. | 200/401 |
| 5,004,875 | 4/1991 | Moody et al. | 200/400 |
| 5,107,715 | 4/1992 | Thuries | 74/2 |

*Primary Examiner*—Allan N. Shoap
*Assistant Examiner*—Stephen Cronin
*Attorney, Agent, or Firm*—M. J. Moran

[57] ABSTRACT

A circuit breaker having a contact movable between open and closed positions, includes a closing spring assembly having a closing spring and first and second brackets. The closing spring assembly is chargeable when in a reset position in which the first bracket is hooked by a first hook. The closing spring is charged, manually or electrically, with support of the second bracket being transferred to a second hook. The closing spring is discharged to close the circuit breaker, with the closing spring assembly moving from the reset position to a discharged position in the process. The closing spring assembly is then moved as an integral unit, back to the reset position, with the closing spring again being charged, enabling the circuit breaker to immediately reclose in the event of a trip due to a transient condition. An improved breaker operating mechanism and power operated charging mechanism, are also disclosed.

42 Claims, 22 Drawing Sheets

CIRCUIT INTERRUPTER HAVING IMPROVED OPERATING MECHANISM

TECHNICAL FIELD

The invention relates in general to metal enclosed switchgear apparatus, and more specifically to circuit interrupters or power circuit breakers used in such apparatus.

BACKGROUND ART

A power circuit breaker having an interrupting rating higher than the type of switchgear apparatus which is commonly referred to as a recloser, is still required to have the ability to immediately re-close at least once after a trip. Thus, when this so-called "open-close-open" feature, or OCO, is required on a circuit breaker which has just been closed, the charging of a closing spring, which was discharged to close the circuit breaker, must be re-charged so that the circuit breaker can be immediately closed following a subsequent trip. This feature of a power circuit breaker provides substantially continuous electrical service for customers of a large block of electrical energy handled by the power circuit breaker, when a momentary power surge, such as a surge caused by lightning, initiates a trip operation.

Circuit breaker operating mechanisms of the prior art which are constructed to store closing energy after the circuit breaker has been closed, generally use a cam and cam follower arrangement. The cam is contoured such that the shaft on which the cam is mounted can be turned to charge a closing spring while the cam follower, which is holding the circuit breaker closed, is held by the cam at a substantially constant radial position. U.S. Pat. No. 4,163,133, which is assigned to the same assignee as the present application, discloses such a prior art cam arrangement.

While the prior art cam arrangement operates satisfactorily, the closing springs may be called upon to be charged over relatively long periods of time, requiring the cam, cam follower, associated shaft and bearings to all be constructed to continuously withstand the high closing spring forces without damage to the operating mechanism, adding significantly to the cost of the mechanism.

Due to the high forces and frictions involved in the cam arrangement, the mechanism associated with the operation of the cam arrangement must also be sophisticated, and therefore costly, in order to prevent freezing-up of the cam arrangement when it is called upon to operate after long periods of withstanding the forces of a charged closing spring.

Cam arrangements also require that the cam and cam follower be precisely located relative to one another, and relative to other parts of the operating mechanism, increasing the manufacturing and assembly cost, as well as complicating maintenance.

Thus, it would be desirable, and it is an object of the invention, to provide a new and improved operating mechanism for a circuit breaker which will provide circuit breaker operating functions similar to those obtainable with the hereinbefore mentioned cam arrangements, including the open-close-open characteristic, while simplifying and reducing the cost of the operating mechanism, all without sacrificing operability and reliability.

Circuit breakers of the types described above, must have the option of being able to electrically charge the closing spring. The charging motor, once it has charged the closing spring to the proper position, must be prevented from continuing to charge the spring. Prior art approaches use brakes, and other costly means to limit rotation of the motor once the desired spring charge has been achieved. It would be desirable, and it is another object of the invention, to provide electrical charging means for the closing spring which eliminates the need for braking the charging motor, thus reducing the cost and complexity of the electrical charging function.

SUMMARY OF THE INVENTION

The invention is a new and improved circuit breaker comprising an electrical contact movable between open and closed positions, a closing spring having first and second spring brackets, charging means for charging the closing spring, discharge means for discharging the closing spring, translating means for moving the electrical contact from the open to the closed position in response to the discharge of the closing spring, and reset means for moving the spring assembly as an integral unit, when the spring assembly is discharged, including the closing spring and the first and second spring brackets. The closing spring assembly is moved by the reset means free from any restraint, other than a guiding restraint, from a discharged position which the spring assembly assumes after discharge, to a reset position. The closing spring is discharged in both the discharged and reset positions, with only the reset position enabling the closing spring to be charged.

In a preferred embodiment of the invention, the charging means includes a first and second hooks. The first hook includes a hooked position in which it releasably holds the first spring bracket, during and after the charging of the closing spring. The second hook includes a hooked position in which it releasably holds the second spring bracket, after the closing spring has been charged. The forces exerted by the closing spring, when charged, are entirely supported by the first and second hooks.

The preferred embodiment further includes a first release arrangement which releases the first hook from the hooked position, resulting in the mechanical release of the first spring bracket from the first hook and the discharge of the closing spring. As soon as the closing spring is discharged, a second release arrangement mechanically releases the second hook from its hooked position, releasing the second spring bracket. With the spring assembly in the discharged position, with both the first and second spring brackets mechanically released and respectively free from the first and second hooks, the reset means now becomes functional, moving the released spring assembly from the discharged position to the reset position. The closing spring assembly is still discharged in the reset position, but the closing spring assembly is now in position ready for charging.

Another embodiment of the invention includes a circuit breaker having new and improved translating means for moving the electrical contact from the open position to the closed position in response to discharge of a closing spring. The translating means includes a linkage assembly and selector means. The selector means operates the linkage assembly as a four bar linkage during closure of the circuit breaker, with the four bar linkage being toggled from a first position to a second position, moving the movable electrical contact to, and maintaining the movable contact in, the closed position, in response to discharge of the closing spring. Trip means is provided for tripping the circuit breaker, with the selector means being responsive to the trip means, converting the four bar linkage to a five bar linkage which releases the movable contact from the closed position.

Another embodiment of the invention includes a circuit breaker having electrical charging means for charging the closing spring, including a charging crank, an electric motor, a ratchet wheel, means for translating rotation of the electric motor to rotation of the ratchet wheel, and a ratchet shaft. The ratchet wheel is mounted on the ratchet shaft such that rotation of the ratchet wheel rotates the ratchet shaft, and a charging cam is also mounted on the ratchet shaft to rotate with the ratchet shaft. The charging cam engages the charging crank during a predetermined angular rotation of the charging cam, to rotate the charging crank and charge the closing spring. Hook means receives and supports the closing spring after the closing spring is charged by the charging crank. The ratchet wheel is mounted on the ratchet shaft to provide a predetermined relative rotational movement between the ratchet shaft and ratchet wheel before engagement, whereby shock forces which may be applied to the charging cam by the charging crank as the charging spring is transferred from the charging crank to the hook means are divided between the charging cam and ratchet wheel, being first applied to the charging cam and ratchet shaft, and then after said predetermined rotational movement of the ratchet shaft, to the ratchet wheel.

Another aspect of the electrical charging means for charging the closing spring includes mechanical oscillator means for translating rotation of the electric motor to rotation of the ratchet wheel. The mechanical oscillator means includes an eccentric mounted for rotation by the electric motor, a shaft mounted off-center on the eccentric, with the shaft having first and second surfaces. First and second levers are mounted for independent rotation on the ratchet shaft, with means being provided for causing the first and second levers to move together. A pawl is mounted for rotation on the first lever, and means is provided for biasing the pawl against the ratchet wheel. The first and second levers each have a predetermined surface which is contacted by the first and second surfaces, respectively, of the shaft mounted on the eccentric, during each revolution of the eccentric. The movement of the first surface against the predetermined surface of the first lever moves the first and second levers and the first pawl from a first position to a second position, to advance the ratchet wheel. The movement of the second surface against the predetermined surface of the second lever moves the first and second levers and first pawl back to the first position, eliminating the need for a costly return spring arrangement.

Still another aspect of the closing spring charging means includes first and second pawls biased against the ratchet wheel. First means, including an electric motor, rotates the ratchet wheel in a predetermined direction, with the first pawl being responsive to the first means for advancing the ratchet wheel. The second pawl functions to prevent rotation of the ratchet wheel in a direction opposite to said predetermined direction. Second means, including a manually operated lever, is also provided for rotating the ratchet wheel in the predetermined direction. The first and second pawls now exchange functions, with the second pawl being responsive to the second means for advancing the ratchet wheel, while the first pawl functions to prevent rotation of the ratchet wheel in a direction opposite to the predetermined direction.

The invention also includes a method of operating a circuit breaker having an operating mechanism which includes a closing spring assembly comprising a closing spring and first and second spring brackets. Charging means is provided for charging the closing spring, and discharge means is provided for discharging the closing spring to close electrical contacts of the circuit breaker. The method includes the steps of holding the first spring bracket, charging the closing spring by the step of moving the second spring bracket, holding the second spring bracket following the charging step, discharging the closing spring by the step of releasing the first spring bracket, to close the electrical contacts of the circuit breaker, releasing the second spring bracket following the step of discharging the closing spring, moving the completely released closing spring assembly as an integral assembly to a reset position, and repeating the steps of holding the first spring bracket, charging the closing spring, and holding the second spring bracket, to enable the circuit breaker to be closed, when desired, immediately following a trip of the circuit breaker.

Other embodiments of the invention relate to improved mechanical interlocking arrangements which permit the resetting of the closing spring assembly without interference from the closing spring charging function, as well as to mechanical interlocks which enable the electrical contacts of the circuit breaker to be closed only when the circuit breaker is open and the closing spring is charged.

BRIEF DESCRIPTION OF THE DRAWINGS

The invention will become more apparent by reading the following detailed description in conjunction with the drawings, which are shown by way of example only, wherein.

DESCRIPTION OF PREFERRED EMBODIMENTS

Figure 1:
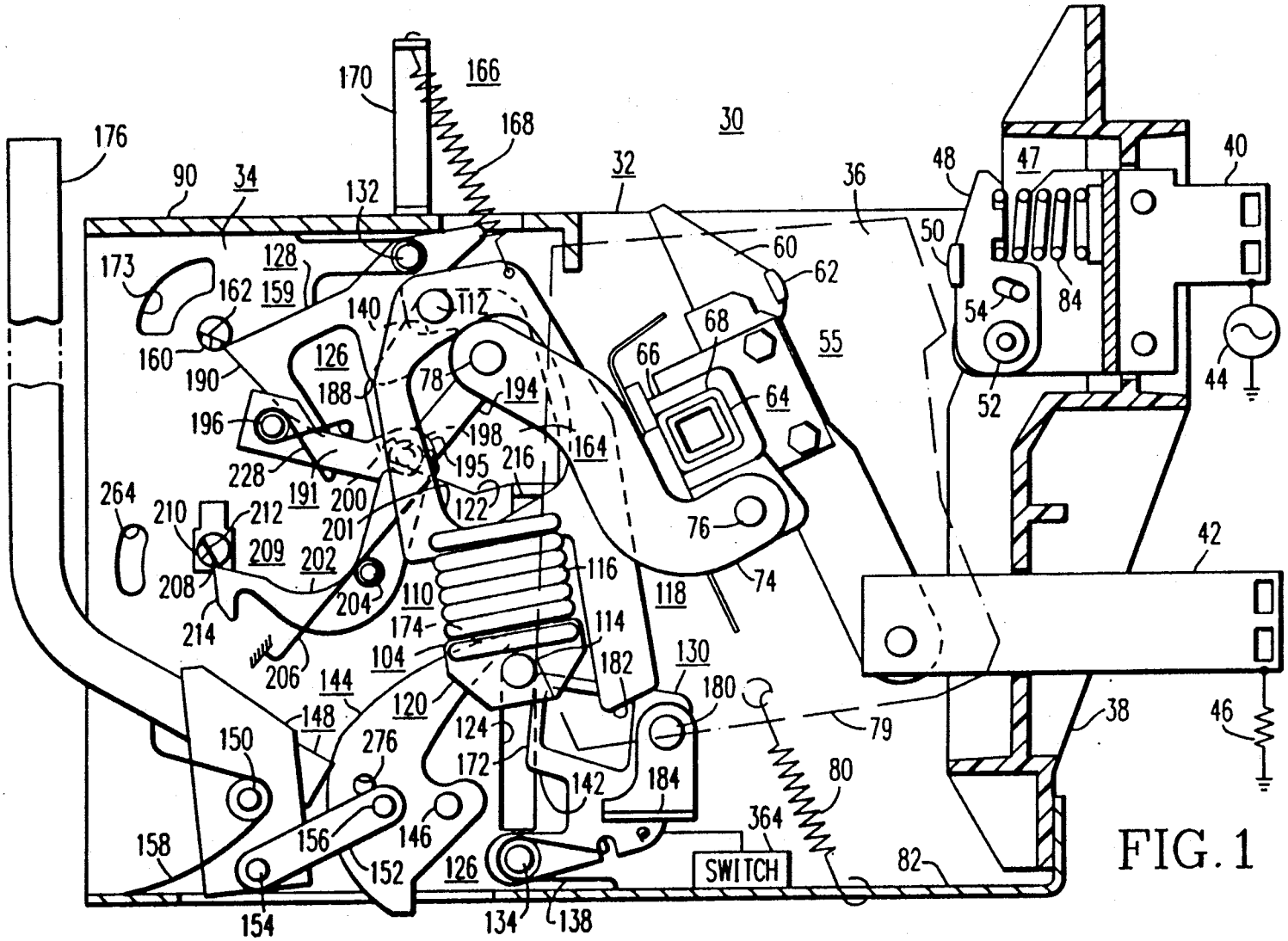
FIG. 1 is a side elevational view of a circuit breaker constructed according to a preferred embodiment of the invention, with the contacts of the circuit breaker open and with a closing spring of an operating mechanism shown in a reset position.
Figure 2:
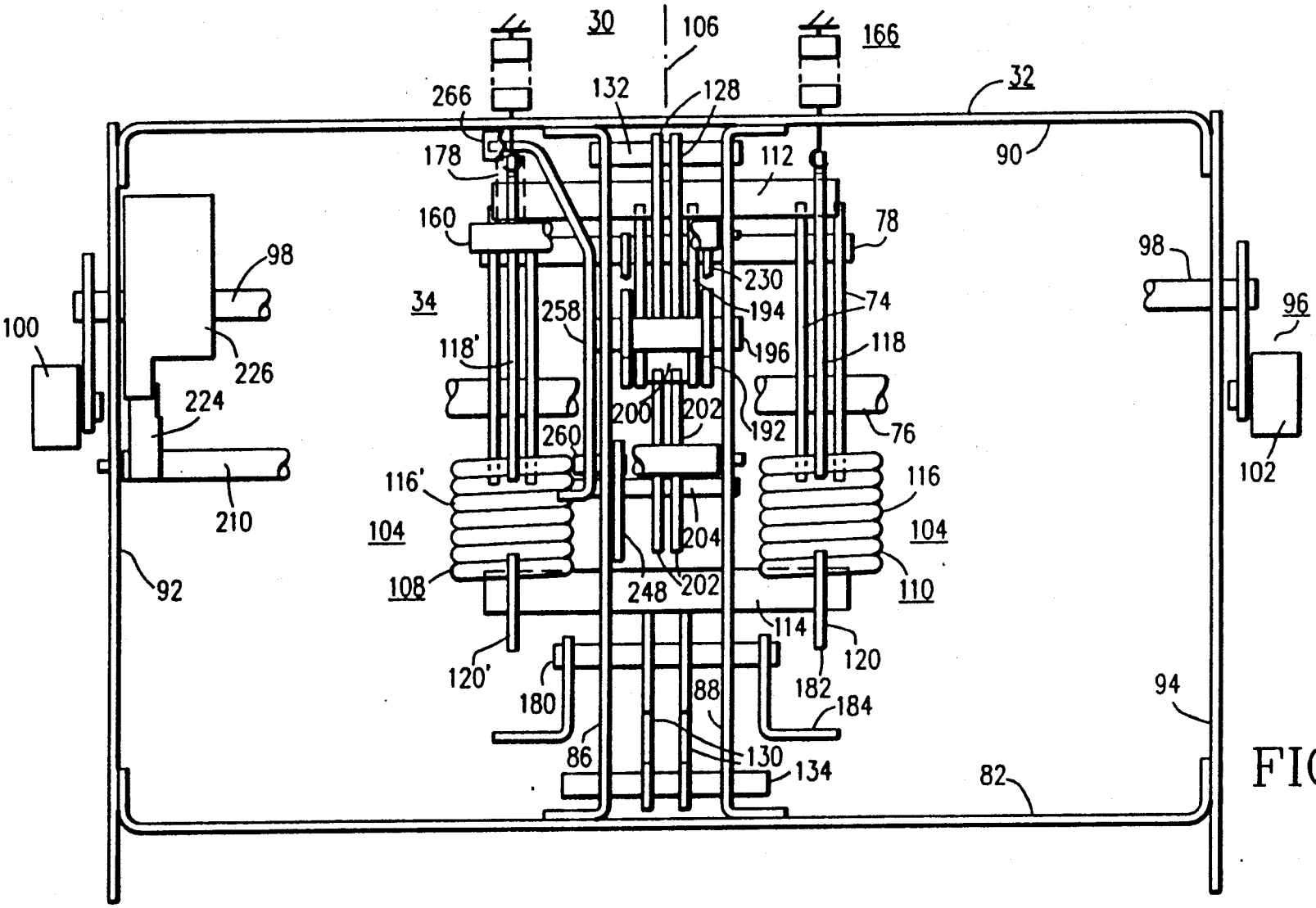
FIG. 2 is an elevational end view of the circuit breaker shown in FIG. 1.

Referring now to the drawings, and initially to FIGS. 1 and 2, there is shown side and end elevational views of a circuit breaker 30 constructed according to a preferred embodiment of the invention. Circuit breaker 30 is an AC power circuit breaker of the type which is usually supplied as part of low voltage metal enclosed switchgear of the drawout type, but it may also be supplied in a fixed mounted version, as desired. Circuit breaker 30 includes a chassis 32 which supports all of the circuit breaker components which include an operating mechanism 34, and three insulated pole unit assemblies 36, only one of which is shown since they are of like construction. Operating mechanism 34 is shown in perspective, isolated from the remaining portions of circuit breaker 30, in FIGS. 3 and 4.

Each pole unit assembly 36 includes an insulative pole base 38 formed of a good electrical insulating material, such as a glass polyester, and upper and lower pole studs 40 and 42 for respective connection to a power source 44 and an electrical load 46. A relatively stationary electrical contact assembly 47 includes a contact head 48, which carries a main contact tip 50. Contact head 48 is mounted for limited pivotal movement on the upper pole stud 40 via a tubular pivot pin 52, and movement limiting means comprising a slot and pin combination 54. A movable electrical contact assembly 55 includes a contact arm 56 which is pivotally mounted on the lower pole stud 42 via a pivot pin 58. A contact head 60, which carries a contact tip 62, is fixed to contact arm 56. An insulative drive bar arrangement 64, which includes a drive bar yoke 66 and a drive bar assembly 68, interconnects the movable contact assemblies 55 of the three pole units 36. Insulative links 74 interconnect the operating mechanism 34 with the drive bar yoke 66, via pivot pins 76 on the yoke 66 and a pivot pin 78 on operating mechanism 34, as will be hereinafter described.

A plurality of insulative barrier members 79, shown in phantom, are mounted on the drive bar arrangement 64 of the movable contact assembly 55, between and outside the three pole unit assemblies 36. Tension springs 80 are connected between certain of the insulative barrier members 79 and a bottom 82 of chassis 32, to bias the movable contact assembly 55 towards the open position, or counter clockwise as viewed in FIG. 1. When circuit breaker 30 is closed, the movable contact assembly 55 applies a force to the stationary contact assembly 47, pivoting the stationary contact assembly 47 through the limited movement allowed, biasing a compression spring 84. When operating mechanism 34 trips circuit breaker 30, movable contact assembly 55 is propelled towards the open position illustrated in FIG. 1, due to the forces stored in springs 80 and 84. Springs 80 and 84 thus cooperatively provide an opening spring function of circuit breaker 30.

Figure 3:
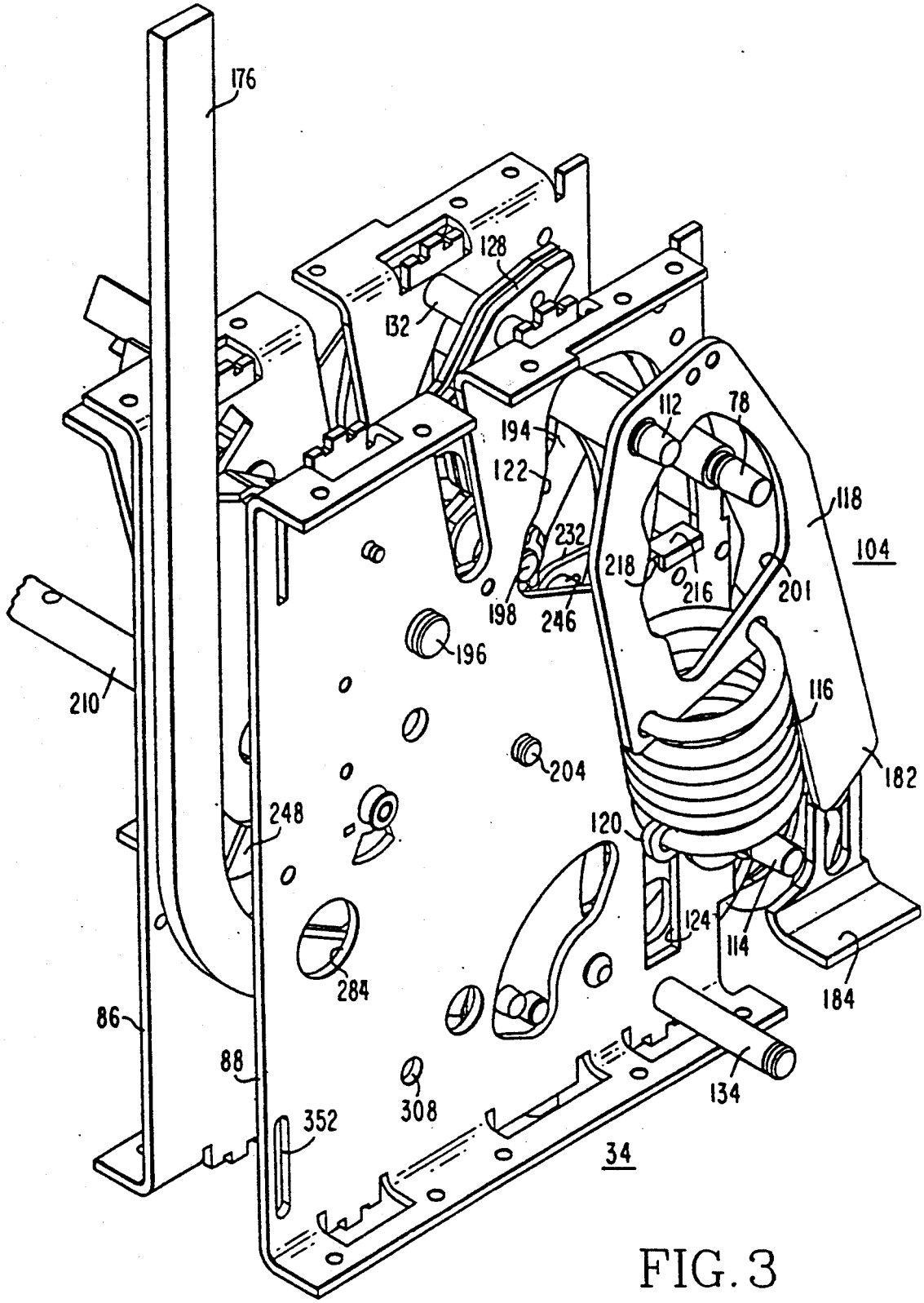
FIG. 3 is a perspective view of the circuit breaker operating mechanism shown in FIG. 1.
Figure 4:
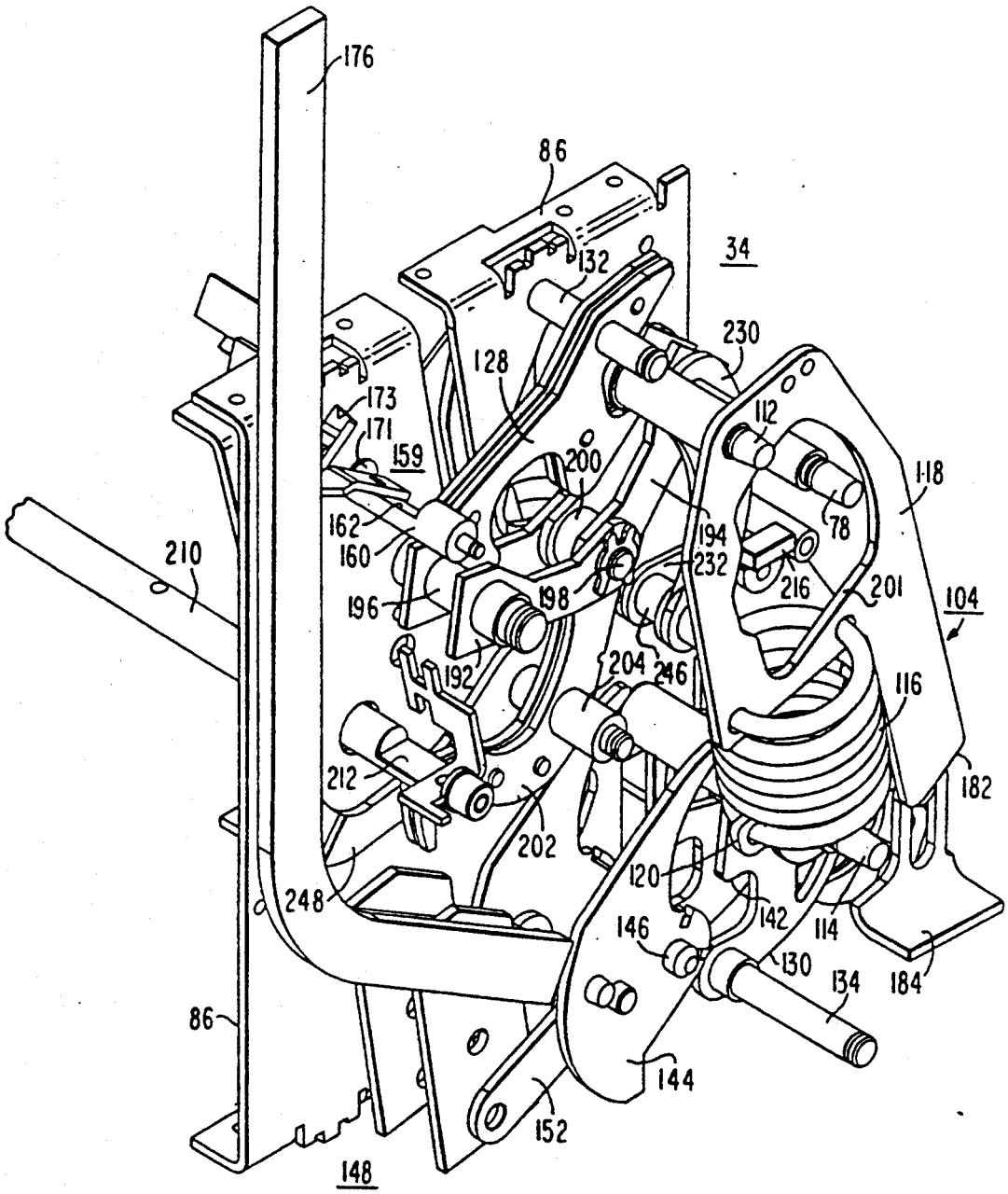
FIG. 4 is a view similar to FIG. 3, except with one of the side frame members of the circuit breaker operating mechanism removed for clarity.

The circuit breaker operating mechanism 34 includes first and second upstanding, spaced frame members 86 and 88, respectively, best shown in FIGS. 2 and 3, which extend between, and are fixed to, the chassis bottom 82 and a top 90 of chassis 32. Operating mechanism 34 is shown in FIGS. 1 and 4 with frame member 88 cut away, in order to more clearly illustrate the various components of the mechanism. Chassis 32 also includes first and second outer side walls 92 and 94 which support a levering-in assembly 96, including a levering-in shaft 98 which extends between the outer side walls 92 and 94, and levering-in rollers 100 and 102. The levering-in assembly 96 moves the circuit breaker 32 relative to a cell in a sheet metal enclosure, between disconnected and connected positions with the source 44 and load 46, as is well known in the art.

Operating mechanism 34 includes a closing spring assembly 104, which, as shown in FIG. 2, is symmetrical about a vertical centerline 106 disposed midway between the first and second frame members 86 and 88. Closing spring assembly 104 includes first and second closing spring sub-assemblies 108 and 110 of like construction, disposed on opposite sides of centerline 106, with the two sub-assemblies 108 and 110 being linked by first and second shaft members 112 and 114. Since sub-assemblies 108 and 110 are of like construction, only closing spring sub-assembly 110 will be described in detail. Like elements of closing spring sub-assemblies 108 and 110 are indicated with like reference numerals, with the addition of a prime mark relative to sub-assembly 108.

Closing spring sub-assembly 110 includes a tension or closing spring 116 and first and second spring brackets 118 and 120 which are attached to opposite ends of closing spring 116. The first shaft member 112 extends between and is fixed to the first spring brackets 118 and 118', and the second shaft member 114 extends between and is fixed to the second spring brackets 120 and 120'. The first shaft member 112 extends through similarly configured large openings 122 in the upstanding support frame members 86 and 88, as best shown in FIG. 3, and the second shaft member 114 extends through vertical guide slots 124 in frame members 86 and 88.

Operating mechanism 34 also includes charging means 126 for charging the closing spring 116, with the charging means 126 including means for releasably holding the closing spring 116 and means for stretching the closing spring 116 to its fully charged condition. The means for releasably holding charging spring 116 includes first and second hook means 128 and 130, respectively. The first and second hook means 128 and 130 are respectively pivotally mounted between frame members 86 and 88 via pivot pins 132 and 134. Torsion springs 136 and 138 respectively disposed on pivot pins 132 and 134 bias the first and second hook means 128 and 130 counter clockwise, and clockwise, respectively, to their "hooked" positions. The first hook means 128 includes a hook portion 140, and the second hook means 130 includes a hook portion 142. When closing spring 116 is fully charged, the first and second hook means 128 and 130 will be in their "hooked" positions, with hook portion 140 supporting shaft member 112 and hook portion 142 supporting shaft member 114.

The means for stretching or charging closing spring 116 in the embodiment of the invention shown in FIG. 1 includes a charging crank 144 pivotally mounted between frame members 86 and 88 via a pivot pin 146, and means for rotating the charging crank 144 in the form of a manually operated handle arrangement 148. Handle arrangement 148 is pivotally mounted between frame members 86 and 88 via a pivot pin 150. A link member 152 is pivotally fixed to handle arrangement 148 and the charging crank 144 via pivot pins 154 and 156. A torsion spring 158 on pivot pin 150 biases handle arrangement 148 clockwise, when viewing FIG. 1. Discharge means 159 for discharging closing spring 116 includes a "closing" D-shaft 160, Which has flat portions 162 which give shaft 160 a "D" shaped cross section at certain locations. Closing D-shaft 160 is biased counter clockwise by a suitable spring (spring 175 in FIGS. 16 and 18). Closing D-shaft 160 prevents the first hook means 128 from rotating clockwise while the charging spring 116 is exerting a force on hook portion 140. The discharge means 159 further includes means in the form of a manually or electrically operated device which rotates closing D-shaft 160 clockwise against its counter clockwise bias. Closing D-shaft 160 is rotated clockwise until a flat portion 162 thereof allows the first hook means 128 to rotate clockwise, past the closing D-shaft 160, under the force of the charged closing spring 116, causing closing spring 116 to discharge. The discharging of closing spring 116 is translated by translating means 164 into movement of contact arm 56 from the open position illustrated in FIG. 1 to a closed position, such as shown in FIG. 8, with the translating means 164 being hereinafter described in detail.

Figure 8:
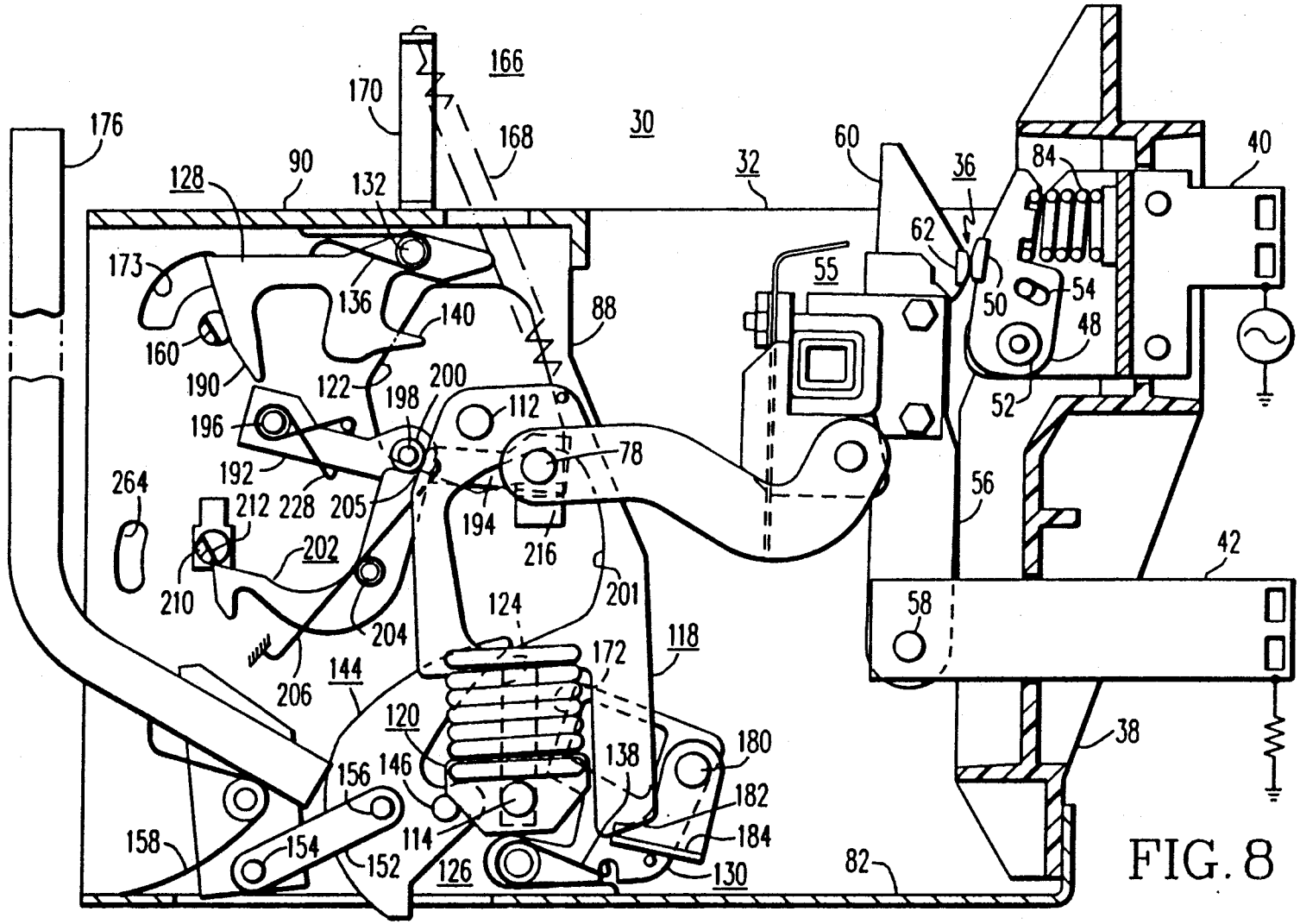
FIG. 8 is an elevational view of the circuit breaker shown in FIG. 1, illustrating the closing spring discharged and the breaker contacts closed.

When closing spring 116 is discharged, spring assembly 104 is immediately moved by reset means 166 from the position it assumes after discharge, e.g., the discharged position shown in FIG. 8, to a reset position, with the reset position being shown in FIG. 1. Reset means 166 includes a tension spring 168 and a support bracket 170, with tension spring 168 being linked between support bracket 170 and the first spring bracket 118.

Figure 5:
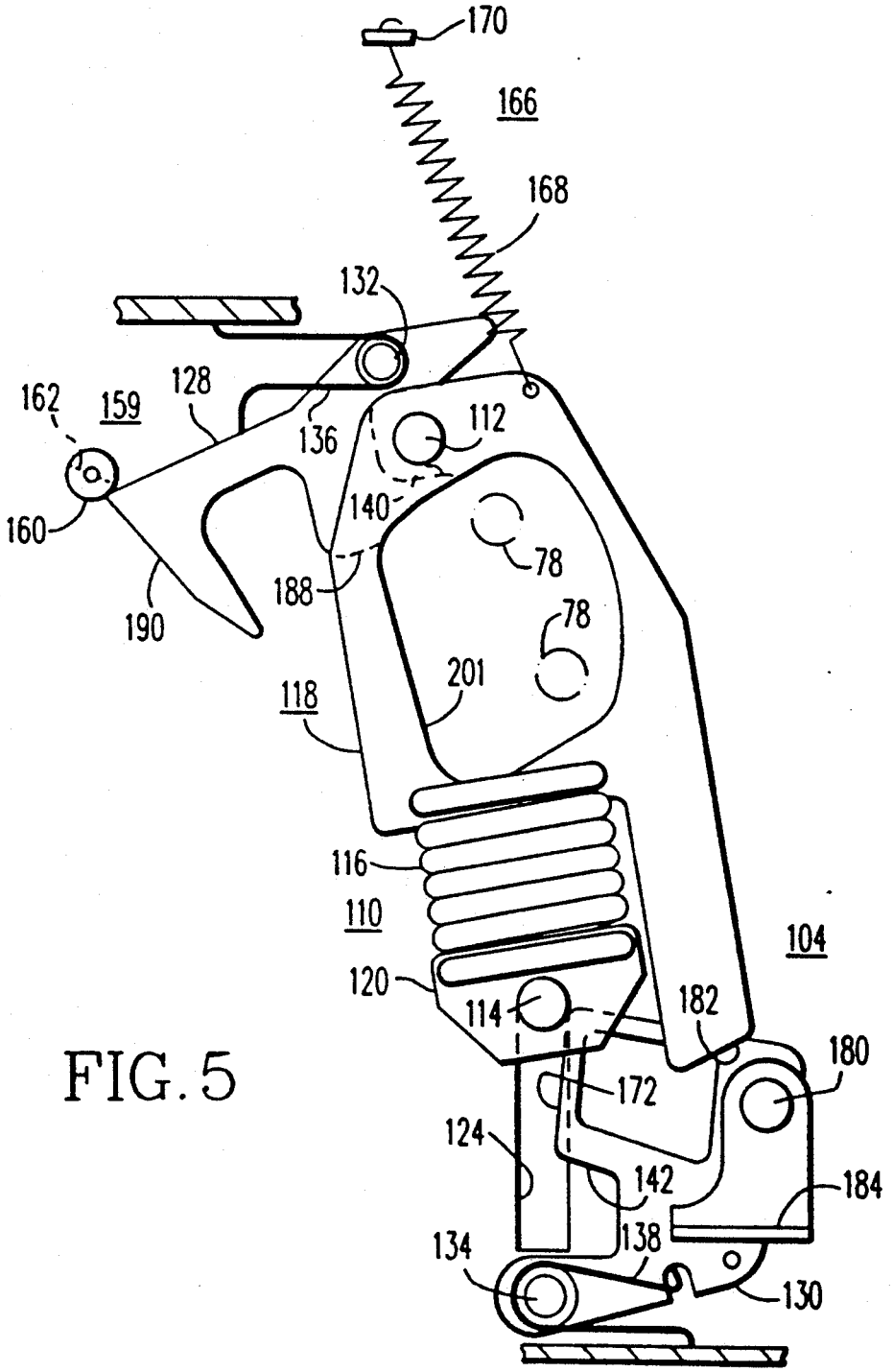
FIG. 5 is an elevational view of the closing spring arrangement shown in FIG. 1.

The following description of the operation of the closing spring function starts with the closing spring assembly 104 in the reset position thereof, and with the circuit breaker 30 open, as illustrated in FIG. 1. For clarity, the closing spring assembly 104, the charging means in the form of the first and second hook means 128 and 130, and the reset means 166, are shown in FIG. 5, isolated from the other functions of operating mechanism 34. In the reset position of closing spring assembly 104 shown in FIG. 1, the first hook means 128 is in the "hooking" position, with hook portion 140 supporting shaft 112, and the closing D-shaft 160 is biased counter clockwise such that the closing D-shaft 160 blocks clockwise rotation of the first hook means 128. A tab 171 on the closing D-shaft 160, shown in FIGS. 4, 16 and 18, contacts an edge of opening 173 in frame member 86 to limit counter clockwise movement of the closing D-shaft 160. A tension spring 175 links tab 171 to the chassis 32 to apply the .counter clockwise bias to closing D-shaft 160.

Continuing with the description of the reset position of closing spring assembly shown in FIG. 1, the second hook means 130 is held "open", against the bias of torsion spring 138, by shaft 114. Shaft 114 is in contact with a long flat surface 172 of the second hook means 130. The charging crank 144 has a charging "finger" 174 in a position which will engage shaft 114 when a handle portion 176 of handle arrangement 148 is rotated counter clockwise, which in turn imparts clockwise rotation to charging crank 144 about its pivot pin 146.

Figure 6:
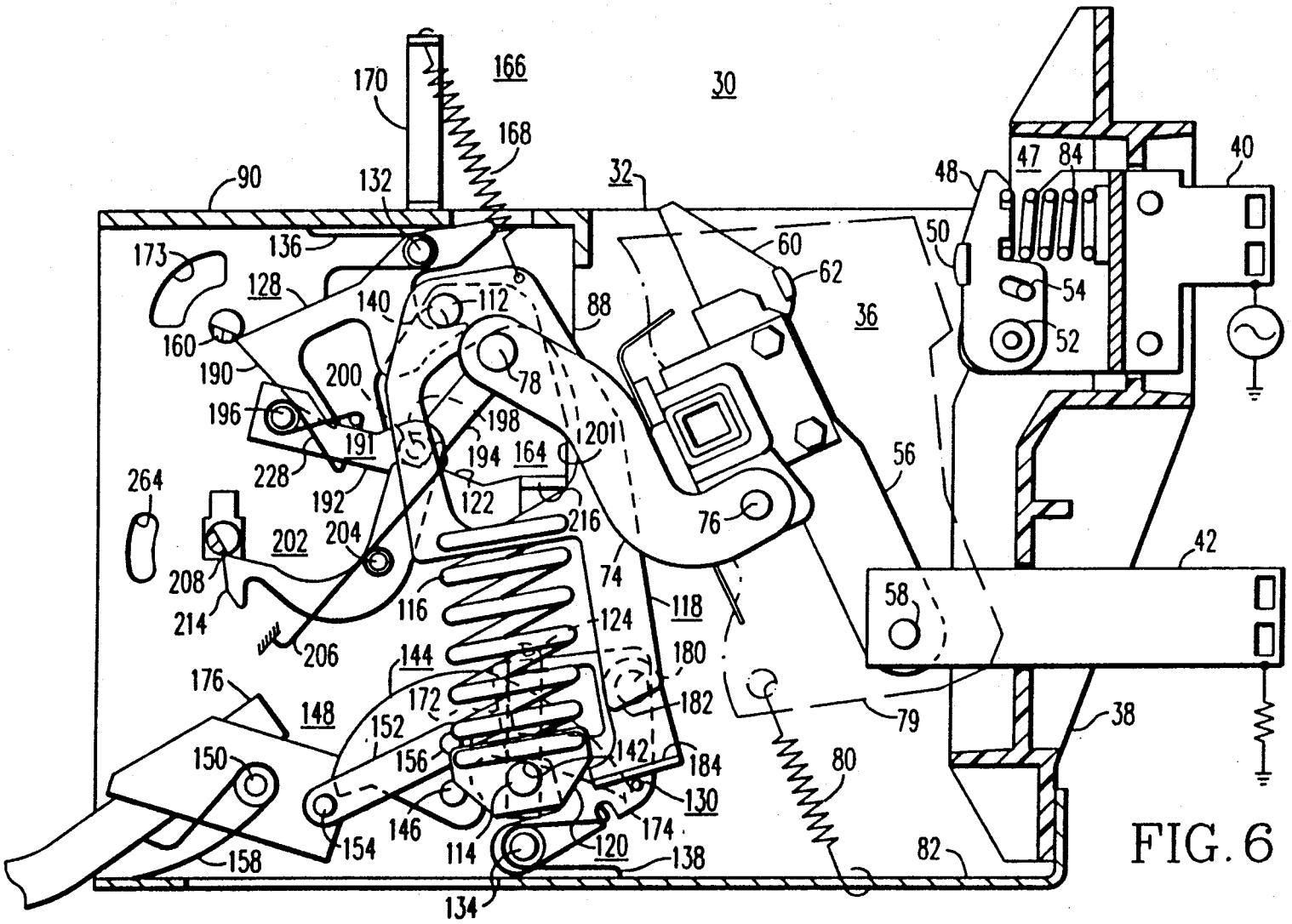
FIG. 6 is an elevational view of the circuit breaker shown in FIG. 1, illustrating the closing spring in a charged configuration.

As handle 176 is pulled downwardly to the position shown in FIG. 6, the closing spring 116 is stretched and shaft 142 moves down the flat restraining surface 172 of the second hook means 130. Surface 172 maintains the second hook means 130 in the open position shown in FIG. 1, until the charging crank 144 pulls shaft 114 below surface 172 and into the hook portion 142 of the second hook means 130. Shaft 114 thus no longer restrains the second hook means 130 from being biased counter clock-wise by spring 138, to the hooking position shown in FIG. 6. Handle 176 may now be moved back to the starting position shown in FIG. 1, as shaft 114 may now be safely transferred from the charging crank 144 to the second hook means 130. Spring 158 biases the handle arrangement 148 to the position shown FIG. 1.

Figure 7:
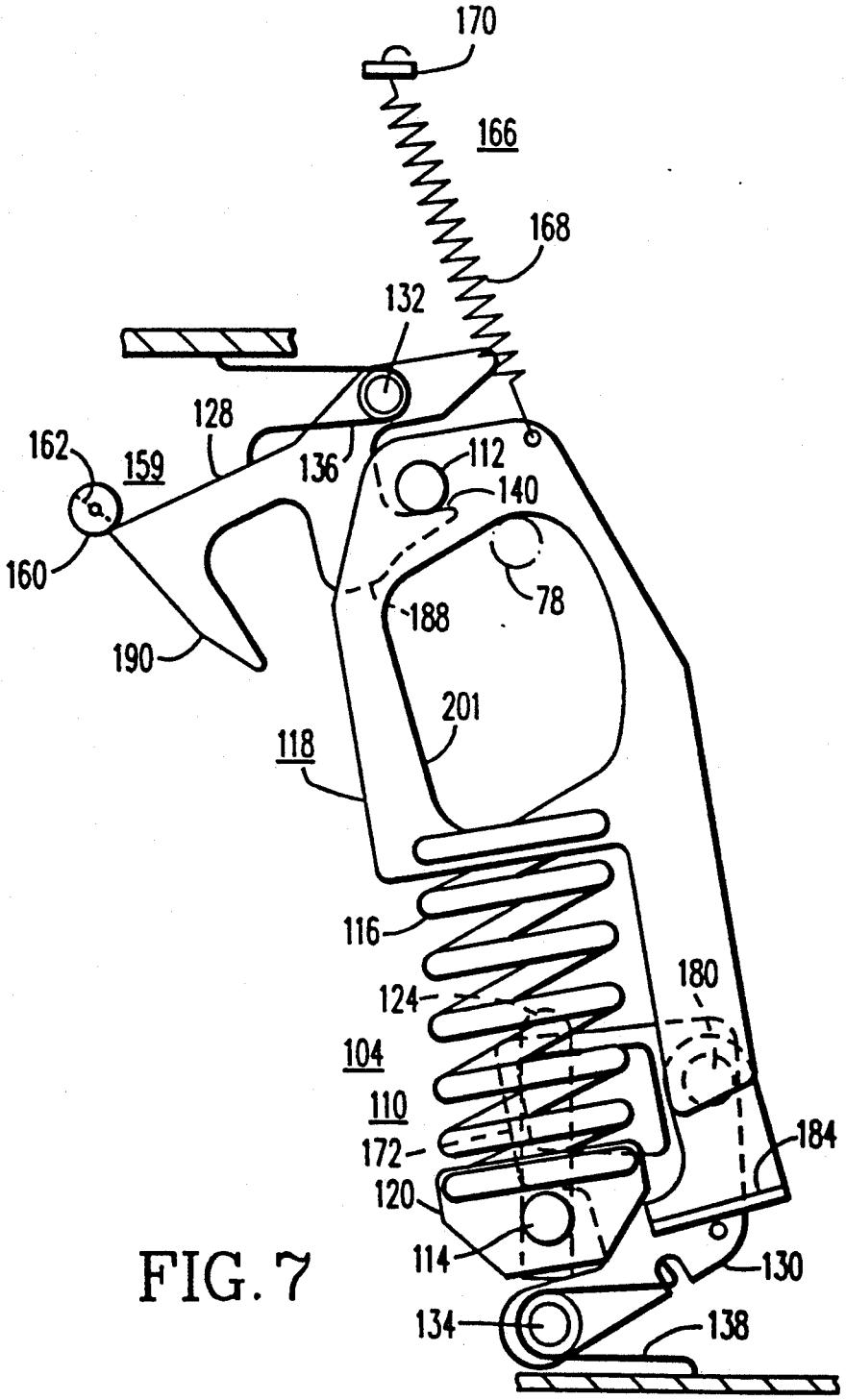
FIG. 7 is an elevational view of the closing spring arrangement shown in FIG. 6.

FIG. 7 is a view similar to FIG. 5, illustrating the charging spring assembly 104 and first and second hook means 128 and 130 in the position that these elements assume in FIG. 6. The closing spring 116 is fully charged, and circuit breaker 30 is still open. It will be noted that when the charging spring 116 is fully charged, that the forces of the charging spring assembly 104 are completely supported by the first and second hook means 128 and 130. Thus, the only elements that must be sized to support the forces of the closing spring assembly 104 are the closing spring assembly 104, the first and second hook means 128 and 130, and the associated pivot pins 132 and 134.

Figure 16:
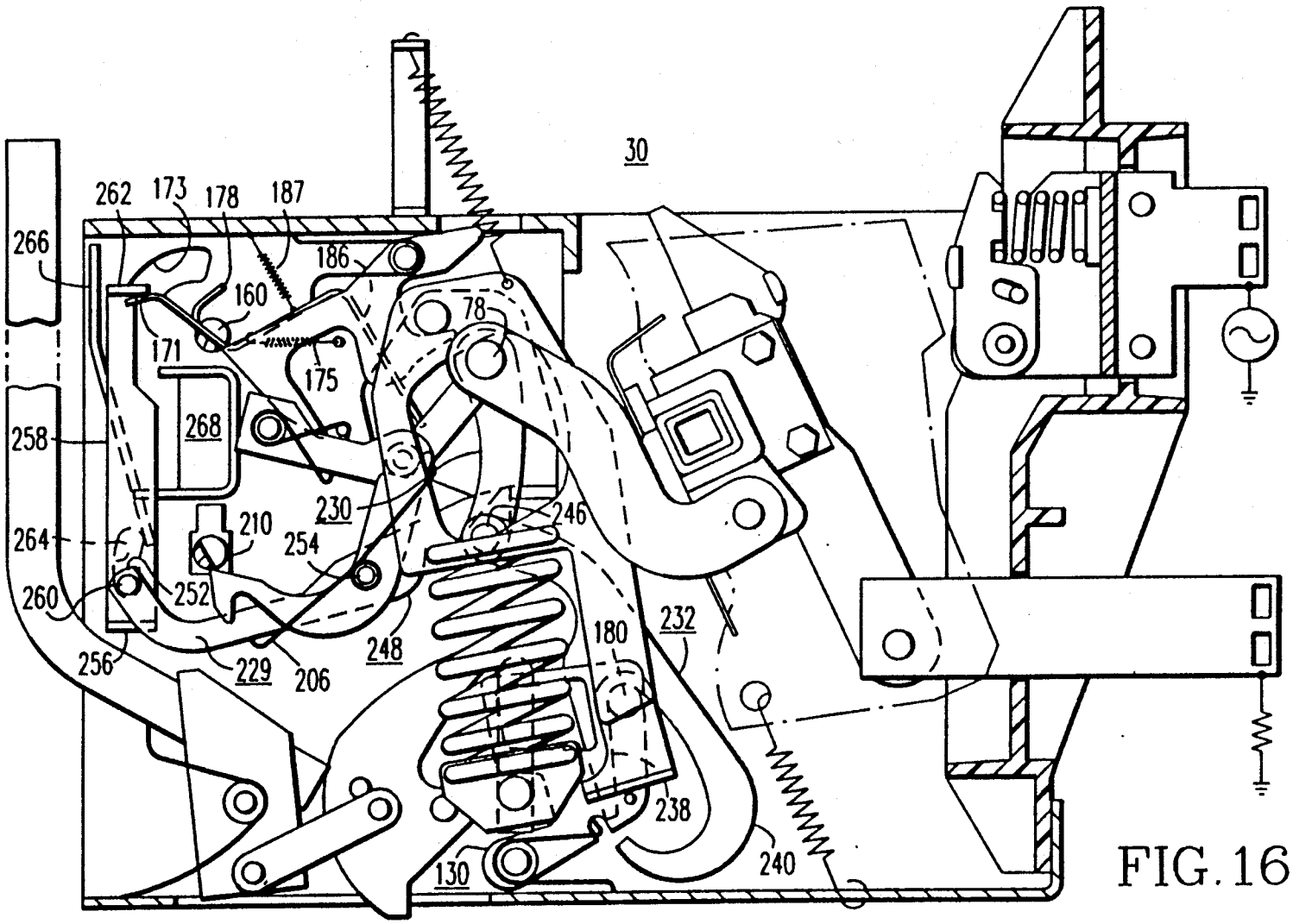
FIG. 16 is a side elevational view of the circuit breaker shown in FIG. 1, in the configuration of FIG. 6, with the closing spring charged and the circuit breaker open, and additionally illustrating an interlock function which enables closing the circuit breaker only when the closing spring in charged and the breaker is open, as illustrated.

Charging means 126 includes means for initiating the closing of circuit breaker 30, which includes a tab 178 on the closing D-shaft 160, shown in fragmentary broken outline in FIG. 2, and in side elevation in FIG. 16. Tab 178 may be actuated manually, or electrically, as will be hereinafter explained, to rotate D-shaft 160 clockwise to a point where it no longer blocks the first hook means 128 from being rotated clockwise under the forces of the charged closing spring 116, i.e., such that the flat portion 162 of closing D-shaft 160 is rotated to an un-blocking position relative to the first hook means 128.

Figure 9:
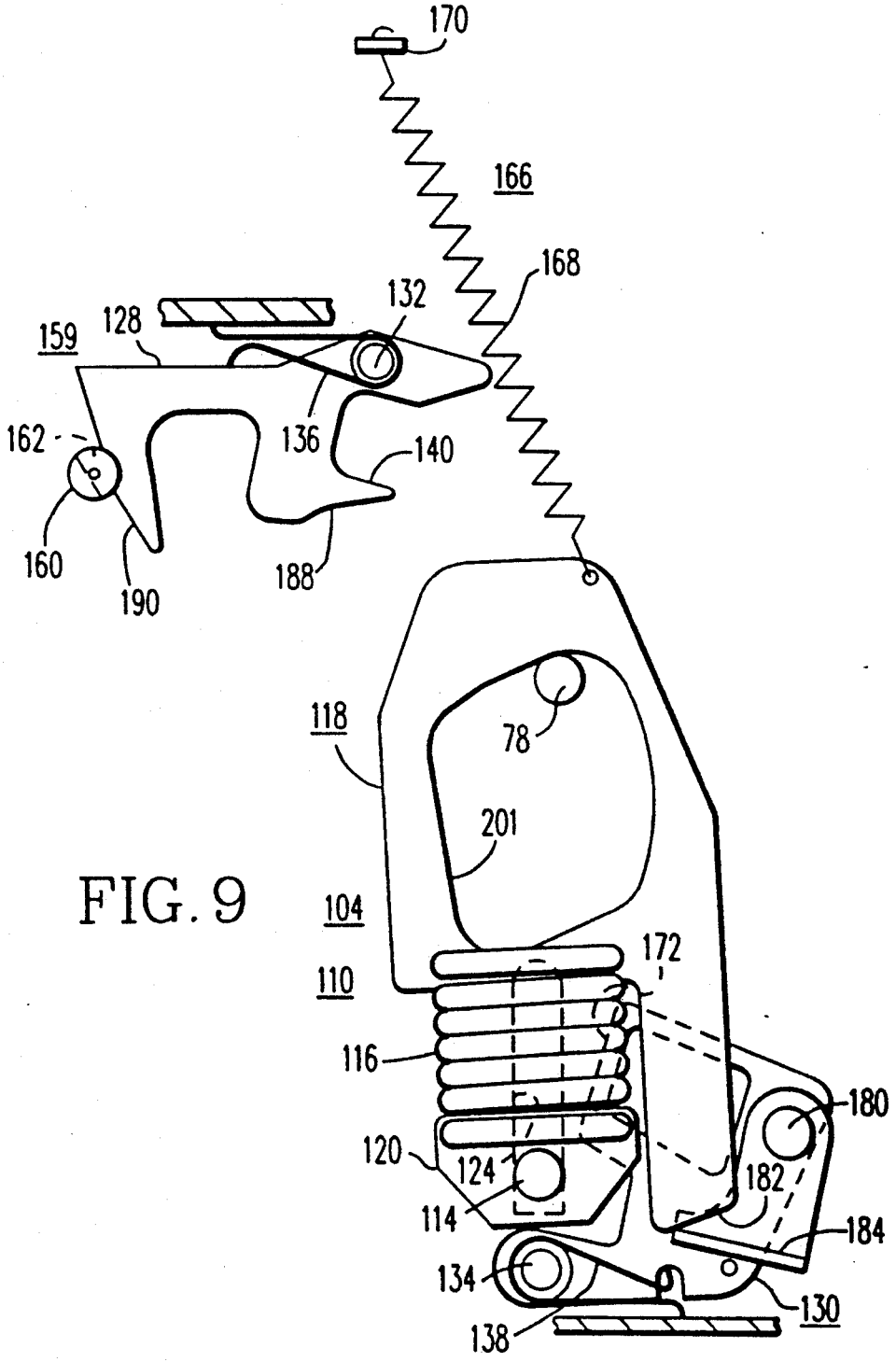
FIG. 9 is an elevational view of the closing spring arrangement shown in FIG. 8.

When the first hook means releases shaft 112, and the first spring bracket 118, closing spring 116 is discharged, which pulls the first spring bracket 118 towards the second spring bracket 130, since the second spring bracket 130 is still holding shaft 114. As will hereinafter be described, the movement of the first spring bracket 118 is translated by translating means 164 into movement of the movable contact arm 56 to the closed position shown in FIG. 8. FIG. 9 is a view similar to those of FIGS. 5 and 7, showing the positions of the closing spring assembly 104, and first and second hook means 128 and 130 which these elements assume in the closed position of circuit breaker 30 shown in FIG. 8.

FIG. 8 illustrates a transient position because a resetting function of the operating mechanism 34 is initiated as the closing spring 116 is discharged. The movement of the first spring bracket 118 towards the second spring bracket 120, in addition to being translated into movement of contact arm 56, is used to release the second spring bracket 120 from the second hook means 130. The second hook means 130 includes a shaft 180, and the first spring bracket 118 includes an integral extension 182. As shown most clearly in FIGS. 1 through 4, a right angle bracket member 184 may be fixed to shaft 180, with the bracket member 184 and integral extension 182 being dimensioned such that as the first spring bracket 118 approaches the discharged position of the closing spring assembly 104, the extension 182 contacts bracket member 184, rotating the second hook means 130 away from the hooked position to a released position. Alternatively, shaft 180 may be lengthened and integral extension 182 dimensioned such that the extension 182 contacts shaft 180 directly, to release the shaft 114 and the lower spring bracket 120 from the second hook means 130.

Once the second hook means 130 releases the second spring bracket 130, the reset means 166 becomes functional to return the closing spring assembly 104 to the reset position shown in FIG. 1. Spring 168 of the reset means 166 is weak compared to the force stored in the charged closing spring 116, and spring 168 is thus stretched or charged as the closing spring 116 contracts towards the restrained second spring bracket 120. Once the closing spring 116 is discharged and the closing spring assembly 104 is no longer constrained by the second hook means 130, spring 168 is selected to be strong enough to contract and move the closing spring assembly 104 as an integral unit, back to the reset position shown in FIG. 1.

When spring 168 starts to return the closing spring assembly 104 to the reset position, the second shaft member 114 is guided by the guide slots 124 in the first and second frame members 86 and 88. The first shaft member 112 is pulled towards the left, when viewing FIG. 8, following the contour of the large openings 122 in the first and second frame members 86 and 88.

Figure 12:
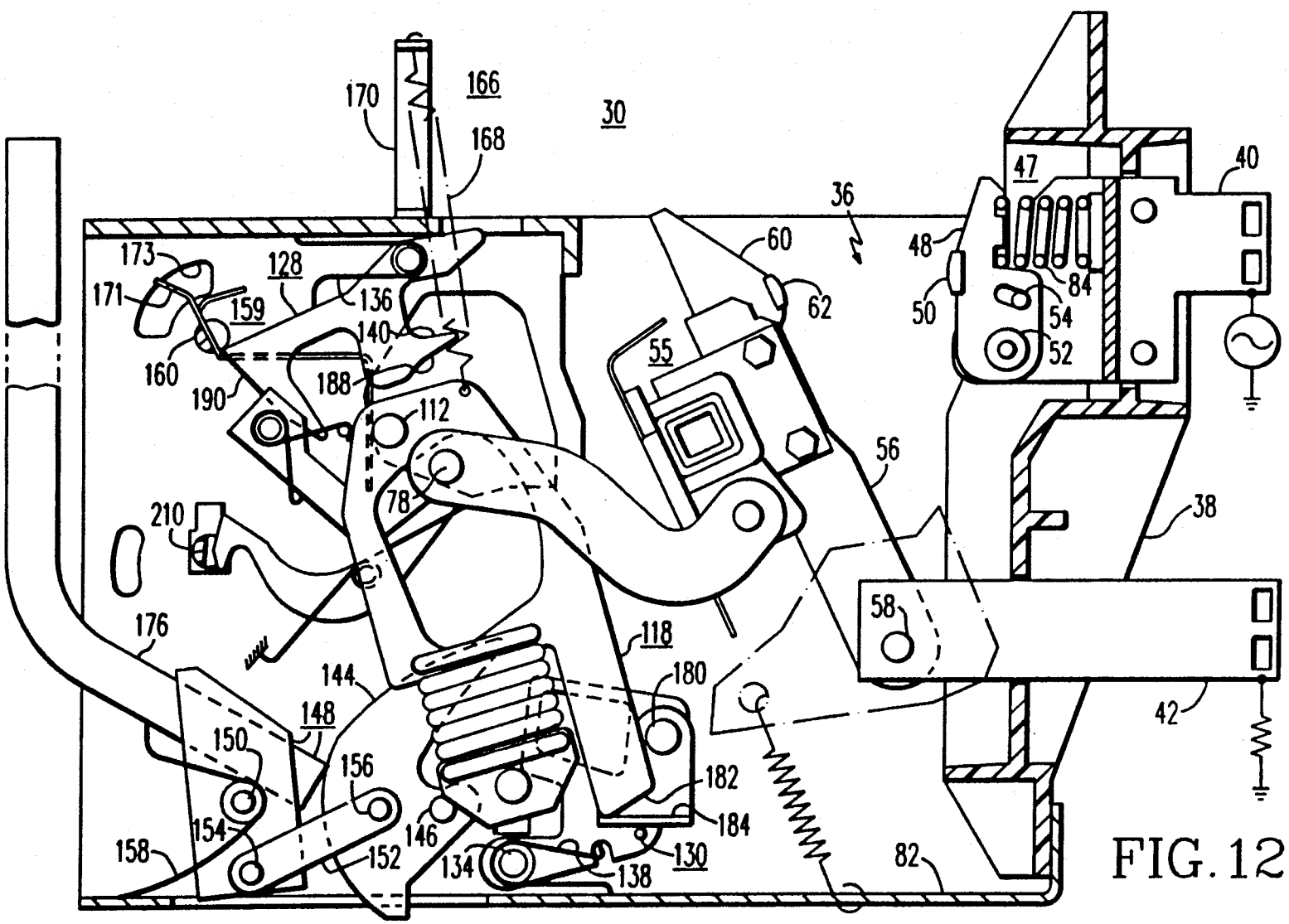
FIG. 12 is an elevational view of the circuit breaker shown in FIG. 1, illustrating a transient view of a close-instantaneous open, or trip-free operation, of the circuit breaker.

The first shaft member 112 contacts an interlock finger 186, shown in FIG. 12, with the interlock finger 186 being fixed to the closing D-shaft 160. A tension spring 187, shown in FIGS. 16 and 18, biases interlock finger 186 counter clockwise when interlock finger is forced clockwise. The contact between shaft 112 and interlock finger 186 overcomes the counter clock-wise bias applied to closing D-shaft 160 by tension springs 175 and 187, forcing closing D-shaft to the "release" position. The first hook means 128, after it released shaft 112, moved back to the hooking position, due to the bias of spring 136. Shaft 112, as it continues to move under the influence of spring 168 towards the reset position, momentarily contacts both the interlock finger 186 and the first hook means 128, pushing the first hook means 128 past the "released" closing D-shaft. Shaft 112 then moves along a flat surface 188 of the first hook means 128, to maintain the first hook means 128 in the released position shown in FIG. 8. When shaft 112 reaches the end of flat surface 188 it has reached the hook portion 140 of the first hook means 128, and since the first hook means 128 is no longer restrained by shaft 112, spring 136 returns the first hook means 112 to the hooked position shown in FIG. 1, where it now constrains shaft 112 and the first spring bracket 118. Once surface 190 of the first hook means 128 moves past the flat portion 162 of the closing D-shaft 160, the bias on the closing D-shaft 160 returns it to its blocking position.

Figure 10:
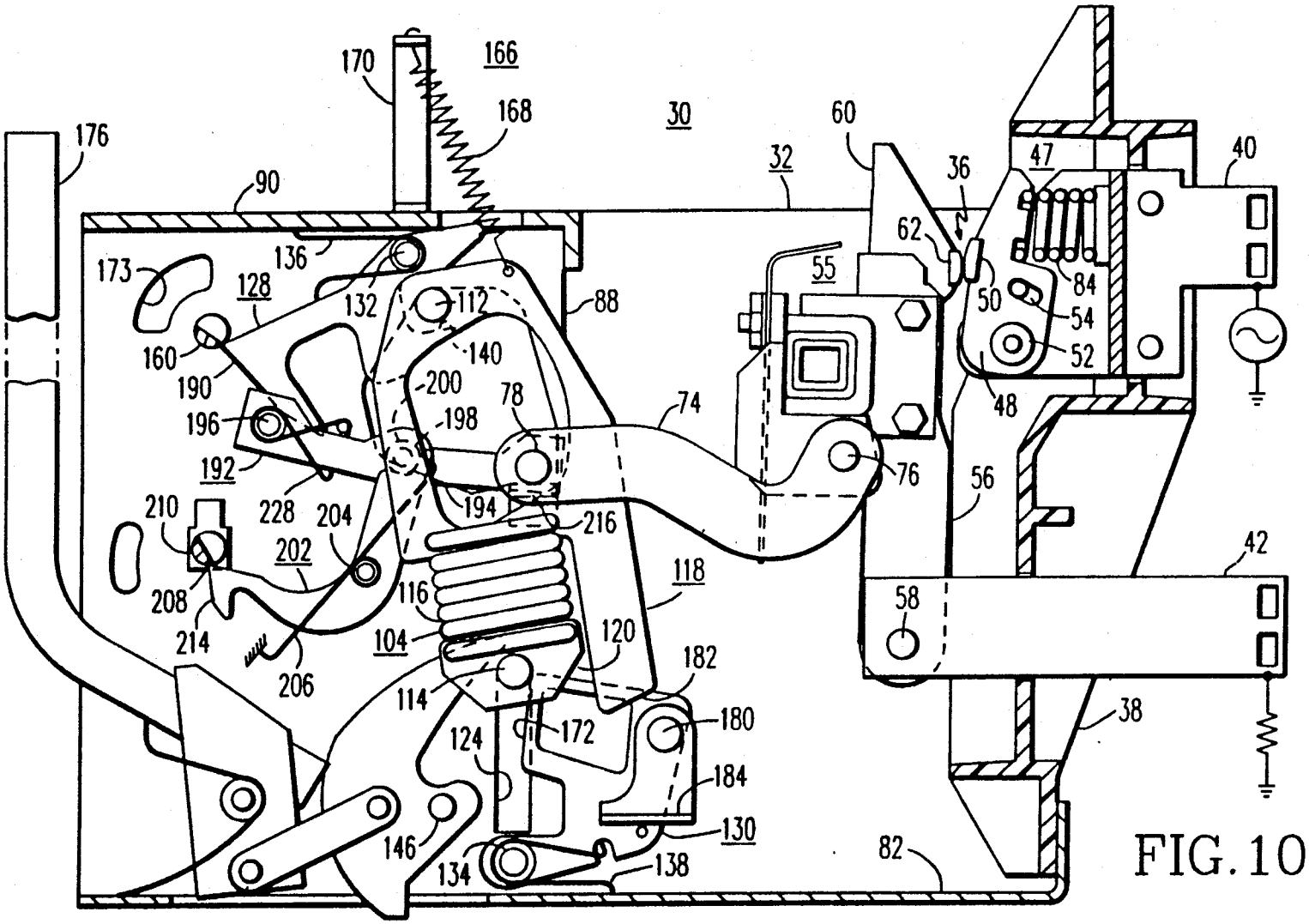
FIG. 10 is an elevational view of the circuit breaker shown in FIG. 1, illustrating the closing spring reset but not charged, and the breaker contacts closed.
Figure 11:
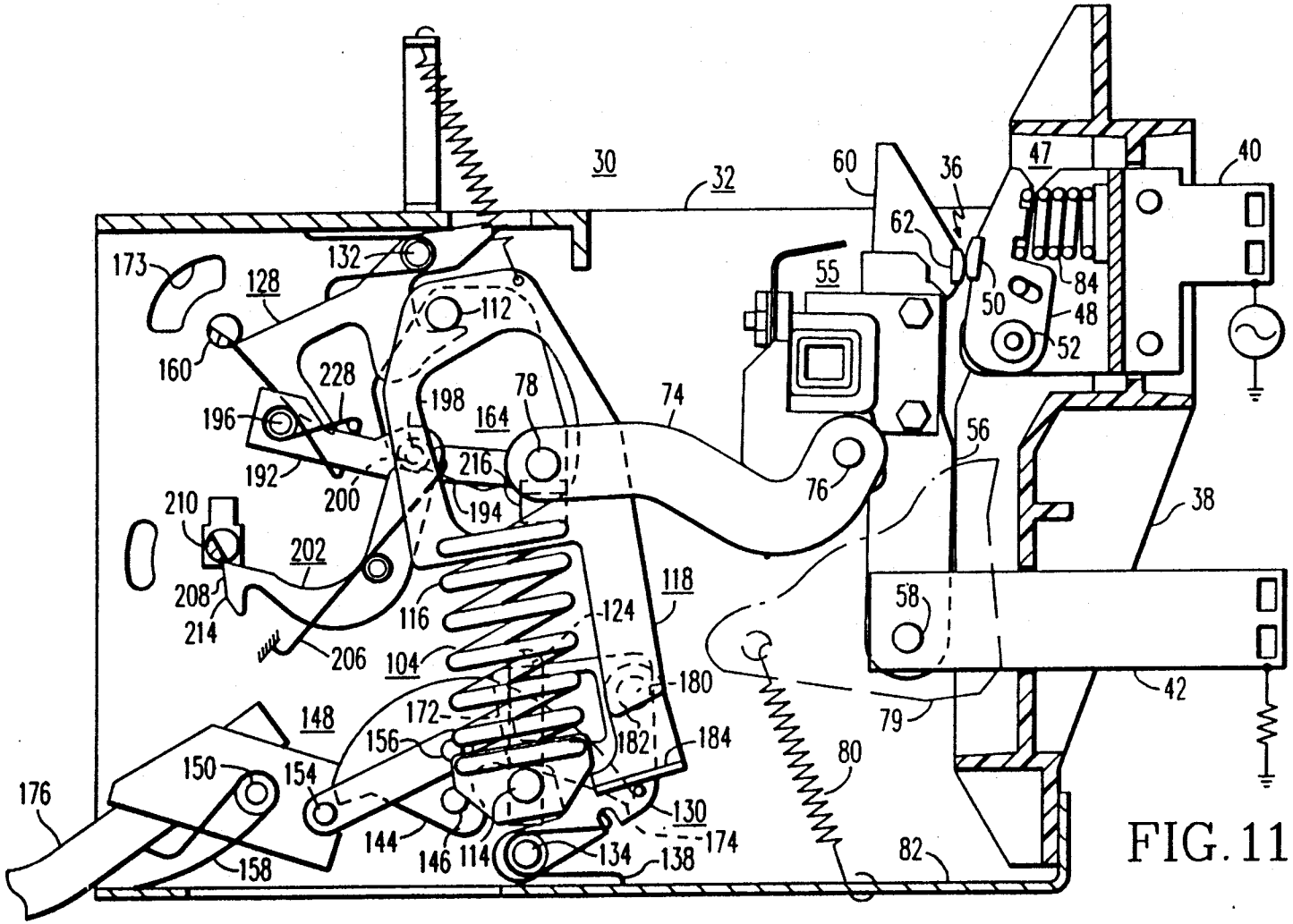
FIG. 11 is an elevational view of the circuit breaker shown in FIG. 1, illustrating the closing spring charged and the breaker contacts closed.

FIG. 10 illustrates circuit breaker 30 closed, and the closing spring assembly 104 reset, but not charged. Thus, the closing spring assembly 104 is in the same position in FIG. 10 as in FIG. 1. FIG. 11 illustrates the charging of the closing spring assembly 104, similar to FIG. 6, and thus circuit breaker 30 is in condition to immediately re-close, should it trip due to a transient condition. If circuit breaker 30 tries to close on a fault, i.e., a non-transient condition, the movable contact arm 56 will remain open, for a trip-free operation, as will be hereinafter described.

The functions of the apparatus described to this point include a new method of operating a circuit breaker having an operating mechanism which includes a closing spring assembly a closing spring and first and second spring brackets. The method includes the steps of holding the first spring bracket, charging the closing spring by the step of moving the second spring bracket, holding the second spring bracket following the charging step, discharging the closing spring by the step of releasing the first spring bracket, to close the electrical contacts of the circuit breaker, releasing the second spring bracket following the step of discharging the closing spring, moving the completely released closing spring assembly as an integral assembly to a reset position, and repeating the steps of holding the first spring bracket, charging the closing spring, and holding the second spring bracket, to enable the circuit breaker to be closed, when desired, immediately following a trip of the circuit breaker.

The translating means 164 which translates movement of the first spring bracket 118 to closure of circuit breaker 30 includes a linkage assembly 191 which is selectively operable as a five bar linkage and as a four bar linkage, with linkage assembly 191 being operated as a four bar linkage during closure of circuit breaker 30. The four bar linkage is converted to a five bar linkage to trip circuit breaker 30.

More specifically, returning to FIGS. 1 and 2, and also referring to FIGS. 13, 14 and 15 which illustrate translating means 164 isolated from the other components of the operating mechanism 34, the translating means 164 is symmetrical about centerline 106, and thus only the portion of translating means 164 located to the right of centerline 106 will be described. The linkage assembly 191 of translating means 164 includes first and second links 192 and 194. The first link 192 has a first end 193 pivotally fixed to the first and second frame members 86 and 88 via a pivot pin 196, and a second end 195. The second end 195 of the first link 192 is pivotally fixed to a first end 197 of the second link 194 via a pivot pin 198. The second link 194 has a second end 199 which is pivotally linked with an end of the hereinbefore described insulating link 74, via the hereinbefore mentioned pivot pin 78. As best shown in FIGS. 2, 3 and 4, pivot pin 78 is elongated, or has an extension thereon, such that it extends into a large opening 201 defined by the first spring bracket 118.

The insulating link 74 thus forms the third link of the linkage assembly 191. The insulating link 74 is pivotally linked with contact arm 56, via pivot pin 76, and thus the movable contact arm 56 which carries the movable contact tip 62 functions as the fourth link of the linkage assembly 191. Contact arm 56 is pivotally fixed to lower pole stud 42, and thus to chassis 32, via the pivot pin 58. With both pivot pins 196 and 58 fixed to chassis 32, the chassis 32 forms the fifth bar of the linkage assembly 191. Chassis 32, and thus the fifth bar, is illustrated in FIG. 13 with a broken line 32.

Figure 15:
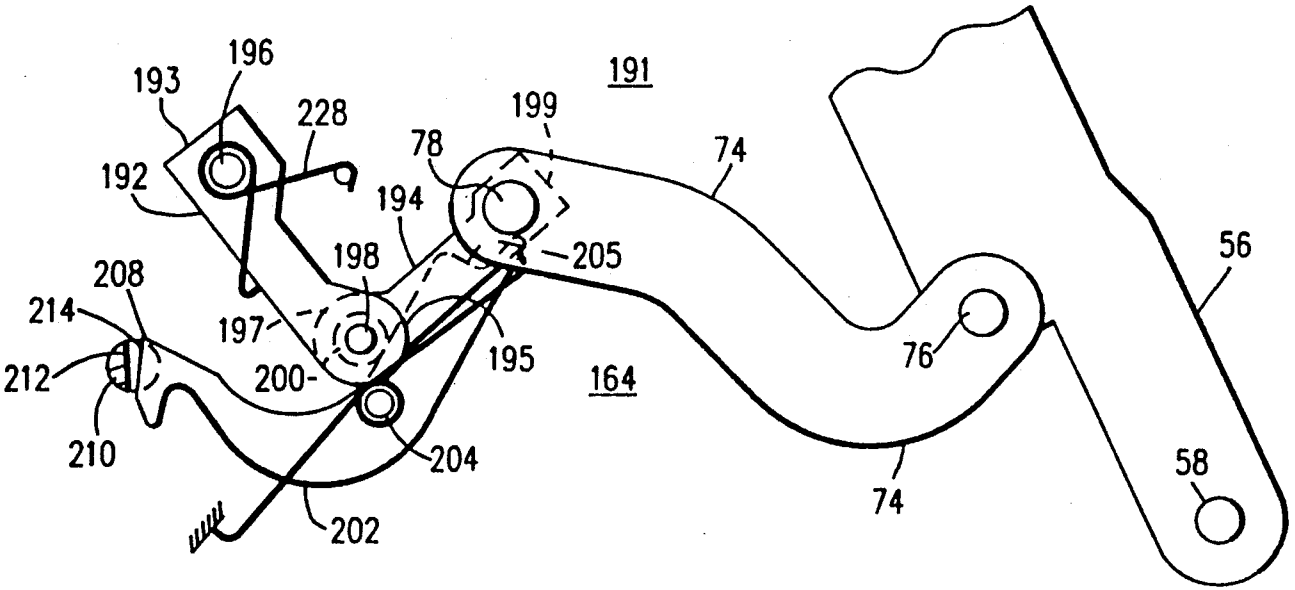
FIG. 15 is an elevational view of the five bar linkage shown in FIG. 12, with the four bar operation of FIGS. 13 and 14 being converted to five bar operation with the trip of the circuit breaker.

When unrestrained, pivot pin 198 is movable between two limits, which will be called an upper limit, illustrated in FIG. 1, and a lower limit, shown in FIGS. 12 and 15. A roller 200 is disposed on pivot pin 198, selector means 203 is provided which converts the linkage assembly 191 from a five bar linkage to a four bar linkage. Selector means 203 includes a prop link 202 which is pivotally fixed to the first and second frame members 86 and 88 via pivot pin 204. Prop link 202 has a first end 205 which is biased against roller 200 by a torsion spring 206, and a second end 208. Trip means 209 is provided for controlling selector means 203. Trip means 209 includes an "opening" D-shaft 210, which has a flat portion 212. Opening D-shaft 210 is biased counter clockwise by a suitable spring (not shown) such that the opening D-shaft 210 blocks clockwise rotation of prop link 202. Rotating opening D-shaft 210 against its bias to a predetermined angular position, enables prop link 202 to be rotated clockwise, with the second end 208 of prop link 202 having a relatively long surface 214 which momentarily maintains D-shaft 210 in the released position during a trip operation.

Figure 13:
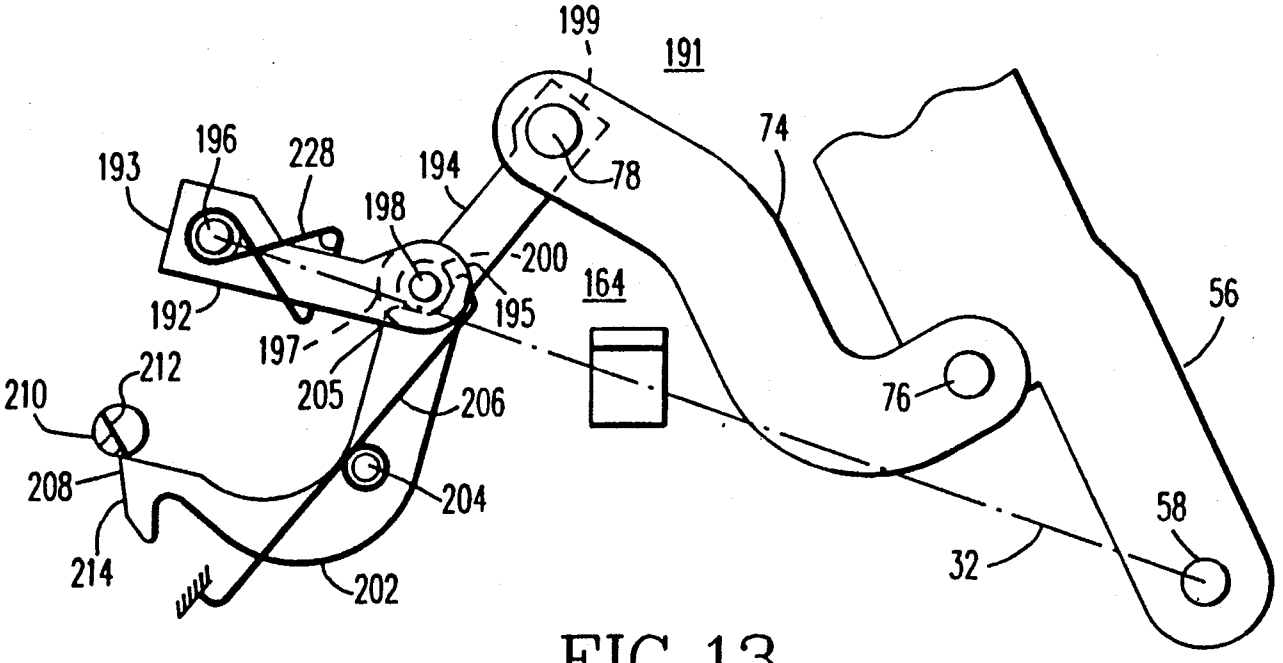
FIG. 13 is an elevational view of a five bar linkage of the operating mechanism shown in FIG. 1, shown being operated as a four bar linkage when the circuit breaker is not in the process of being tripped, with the circuit breaker being shown in the open position.

The prop link 202 normally locks pivot pin 198 at the upper limit, as shown in FIGS. 1 and 13, converting the linkage assembly 191 from a five bar linkage to a four bar linkage. With the location of pivot pin 198 momentarily fixed, movement of contact arm 56 from an open to a closed position may be achieved by moving pivot pin 78 downwardly, as viewed in the Figures. Thus, when the closing spring 116 is discharged and the first spring bracket 118 moves rapidly downward it strikes the extended pivot pin 78, forcing pivot pin 78 downwardly against a stop member 216 located in a notch 218 formed in opening 122 of the first and second frame members 86 and 88, as shown in FIG. 3.

Figure 14:
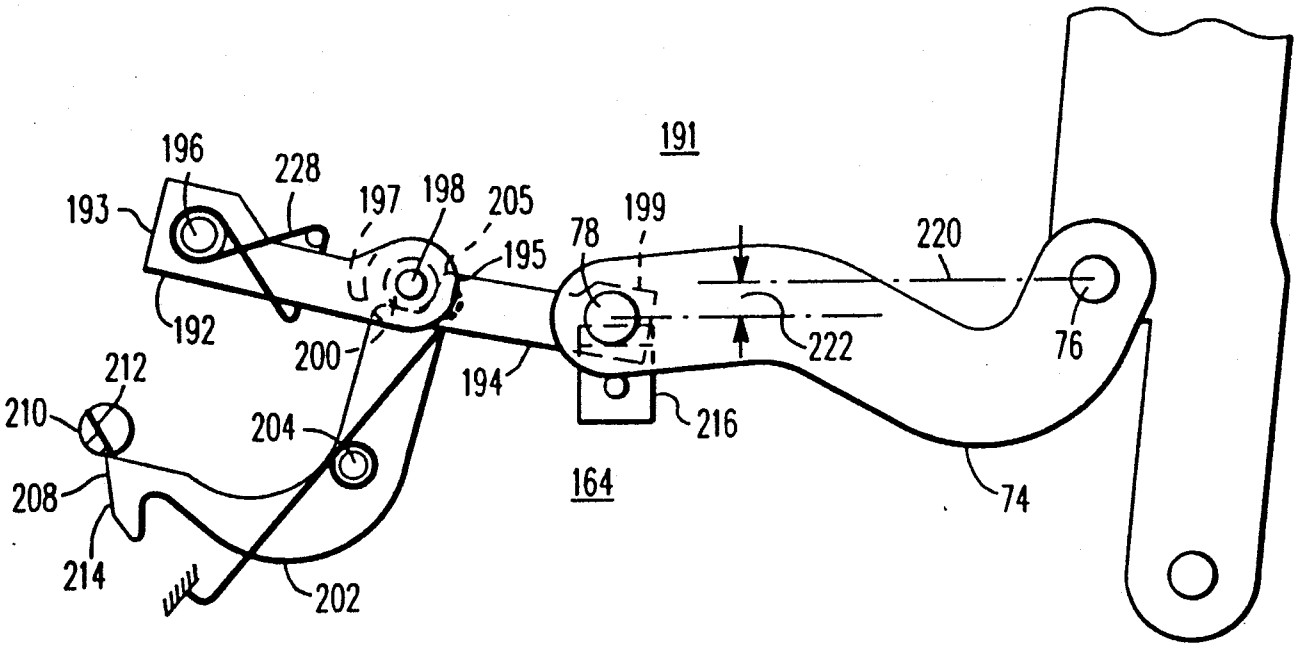
FIG. 14 is an elevational view of the five bar linkage shown in FIG. 8, shown being operated as a four bar linkage, with the circuit breaker being shown in the closed position.

As shown in FIGS. 8 and 14, pivot pin 78 is forced below a centerline 220 disposed between pivot pins 196 and 76, forcing pivot pin 78 over-center by a dimension 222. As pivot pin 78 goes over center, opening springs 84 disposed behind the relatively stationary contacts 48 are compressed, holding the four bar linkage in the over-center position shown in FIGS. 8 and 14. The large aperture or opening 201 in the first spring bracket 118 is dimensioned to allow the closing spring assembly 104 to be reset and recharged, without disturbing pivot pin 78 and the closed circuit breaker 30.

To open or trip circuit breaker 30 only requires that the propped pivot pin 198 be released, converting the four bar linkage to a five bar linkage. With pivot pin 198 unrestrained, the opening springs 84 and 80 will propel the movable contact arm 56 towards its open position, driving pivot pin 198 to its lower limit. Releasing pivot pin 198 is accomplished by rotating the opening D-shaft clockwise, against its bias, to allow end 208 of prop link 202 to move past the flat portion 212 of the opening D-shaft 210. Rotation of the opening D-shaft 210 may be accomplished manually or electrically. As shown in FIG. 2, the opening D-shaft 210 may have a tab 224 which is engaged by a pivotable actuating member 226 when it is desired to trip circuit breaker 30. Actuating member 226 may be a clapper of a trip relay, for example, and the lower end of actuating member 226 may also be manually pushed inward, when viewing FIG. 2, to manually trip circuit breaker 30. When circuit breaker 30 is tripped, the linkage assembly 191, now functioning as a five bar linkage, momentarily assumes the position shown in FIGS. 12 and 15, wherein the propped pivot pin 198 and associated roller 200 are driven downwardly to the lower limit.

As soon as circuit breaker 30 is tripped, a torsion spring 228 disposed about pivot pin 196 biases the first link 192 counter clock-wise, lifting pivot pin 198 to the upper limit, and torsion spring 206 lifts the prop link 202 such that its first end 205 engages roller 200. If the trip was due to a transient, the opening D-shaft 210 will be biased back to the blocking position, and circuit breaker 30 may be immediately re-closed by actuation of the closing D-shaft 160. If the trip was not due to a transient, opening D-shaft 210 will still be in a non-blocking orientation, and a closing operation will result in collapse of pivot pin 198, resulting in a tripfree operation, such as shown in FIG. 12. In other words, an attempt to re-close on a fault will result in circuit breaker 30 remaining open, as the five bar linkage has not been effectively converted to a four bar linkage. Moving pivot pin 78 downwardly with pivot pin 198 unrestrained, merely collapses the linkage about pivot pin 198, resulting in no appreciable movement of the movable contact arm 56 from the open position towards the closed position.

The resetting operation of the closing spring assembly 104 required an interlock 186 between the resetting function and the charging function, temporarily causing the closing D-shaft 160 to assume a non-blocking rotational position, enabling the first hook means 128 to be moved out of the way as the closing spring assembly 104 is moved by the reset means 166 from the discharged position shown in FIG. 8 to the reset position shown in FIG. 1.

Figure 19:
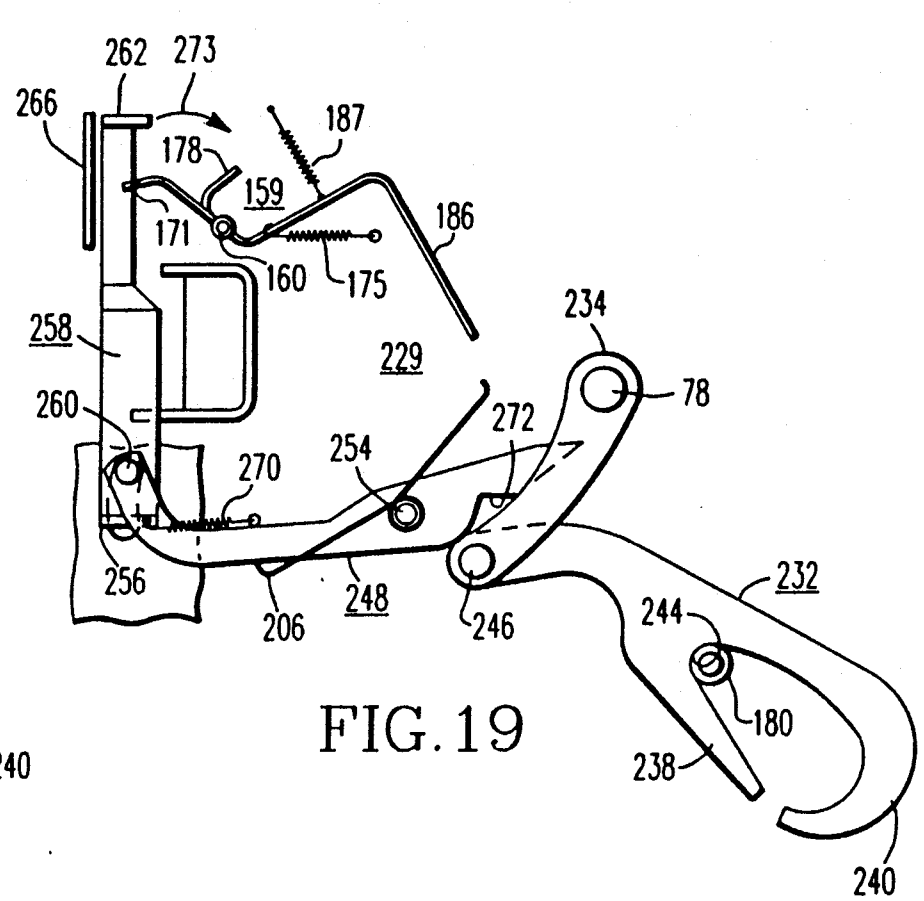
FIG. 19 is a side elevational view of the interlock elements shown in the configuration of FIG. 18.
Figure 17:
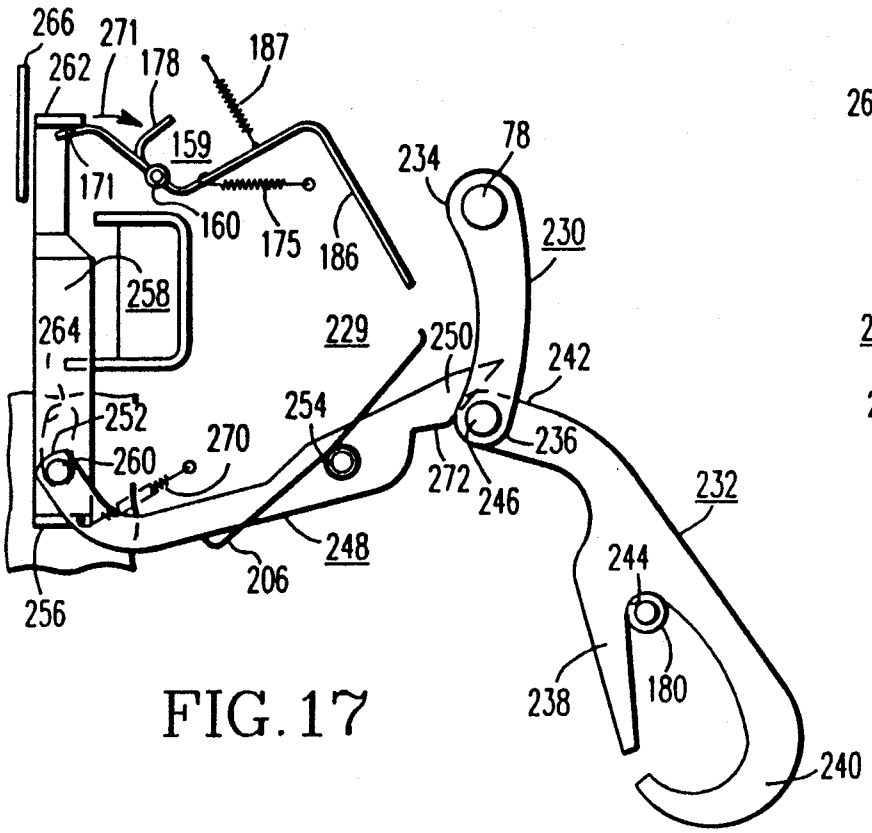
FIG. 17 is a side elevational view of the interlock elements shown in the configuration of FIG. 16.
Figure 18:
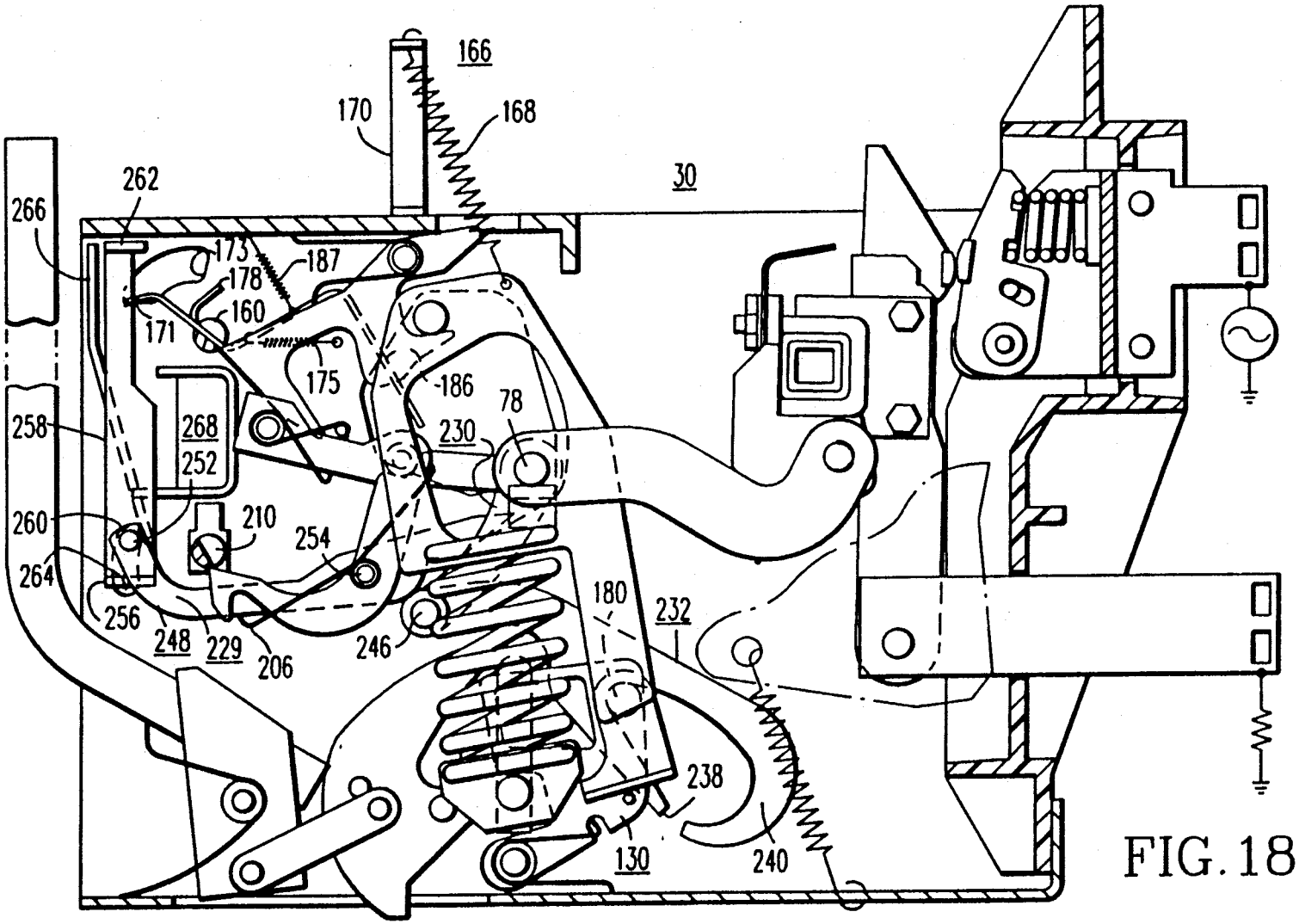
FIG. 18 is a side elevational view of the circuit breaker shown in FIG. 1, in the configuration of FIG. 10, with the circuit breaker closed and the closing spring charged, and additionally illustrating the interlock function of FIG. 16, except with the interlocks in a configuration which prevents closure of the circuit breaker.

Power circuit breaker 30 additionally includes an interlocking function which prevents discharge of a charged closing spring when circuit breaker 30 is already closed, i.e., the position shown in FIGS. 6 and 7. FIG. 16 illustrates circuit breaker 30 with an interlocking arrangement 229, with the interlocking elements thereof being shown in a configuration which permits closing of circuit breaker 30, as the circuit breaker 30 is open and the closing spring 116 is charged. FIG. 17 illustrates the elements of the interlocking arrangement 229 isolated from the other elements of the operating mechanism 34. FIG. 18 illustrates circuit breaker 30 closed with the closing spring 116 charged, and thus the interlocking elements are shown in a configuration which blocks an attempt to close the breaker. FIG. 19 illustrates the elements of the interlock arrangement 229 in the blocking configuration of FIG. 18.

The information relative to whether circuit breaker 30 is open or closed is obtained from the position of pivot pin 78 via a first interlock link 230. When circuit breaker 30 is open, pivot pin 78 is in the uppermost of two limit positions, and when circuit breaker 30 is closed, pivot pin 78 is in the lowermost of two limit positions, as hereinbefore explained.

The information relative to whether the charging spring 116 is charged is obtained from the position of the second hook means 130 via a second interlock link 232 which is responsive to the shaft 180 which is fixed to the second hook means 130. When the closing spring 116 is charged, the second hook means 130 and its associated shaft 180 will be pivoted to a limit position to the left, when viewing FIG. 16, and when the closing spring 116 is not charged, the second hook means 130 and shaft 180 will be pivoted to a limit position to the right.

The first interlock link 230 has a first end 234 which is pivotally linked to pivot pin 78, and a second end 236. The second interlock link 232 has an inverted Y configuration, having first and second depending fingers 238 and 240, and an upwardly extending stem portion 242. The depending fingers 238 and 240 define a notch 244 dimensioned to rest upon shaft 180 of the second hook means 130, and the stem portion 242 is pivotally linked with the second end 236 of the first interlock link 230 via a pivot pin 246. When circuit breaker 30 is open and charged pivot pin 246 will be pulled upwardly and to the left, when viewing the Figures, to a first position, best shown in FIG. 17. When circuit breaker 30 is closed, pivot pin 246 will be forced downwardly to a second position, best shown in FIG. 19. A third interlock link 248 having first and second ends 250 and 252 is pivotally fixed between the first and second frame members 86 and 88 via a pivot pin 254. The second end 252 of the third interlock link 248 is pivotally fixed to a first end 256 of a fourth interlock link 258 via a pivot pin 260. The fourth interlock link 258 has a second end 262. Pivot pin 260 extends through an elongated slot or opening 264 in the first frame member 86. An attempt to close circuit breaker 30 pivots a clapper 266 of an electric close coil 268 to the right, when viewing FIGS. 16–19, or clapper 166 may be manually actuated. Movement of clapper 266 against the fourth interlock link 258, moves the upper end 262 thereof clockwise about pivot pin 260. The third interlock link 248 is biased clockwise about pivot pin 254. The same torsion spring 206 which biases the prop link 202 counter clockwise may be used to bias the third interlock link 248 clockwise. A tension spring 270 biases the fourth interlock link 258 counterclockwise about pivot pin 260, as viewed in the Figures, to insure that interlock link 258 will be in the desired position adjacent to clapper 266.

When circuit breaker 30 is in condition to be closed, as illustrated in FIGS. 16 and 17, i.e., circuit breaker 30 is open with the closing spring 116 charged, pivot pin 246 will be moved into engagement with a surface 272 near the first end 250 of the third interlock link 248, pivoting the third interlock link against the bias of springs 206 and 270, moving pivot pin 260 to the bottom the slot 264 in frame member 86. Now, if clapper 266 is pivoted to the right, when viewing the Figures, pivoting the fourth interlock link 258 to the right, about its pivot pin 260, as indicated by arrow 271, end 262 will contact tab 178 on the closing D-shaft 160, rotating D-shaft 160 to a non-blocking position which initiates the closing of circuit breaker 30.

If circuit breaker 30 is not in condition to be closed, as shown in FIGS. 18 and 19, either because the breaker is already closed, or the closing spring 116 is not charged, in either case pivot pin 246 will be moved to a position where it cannot engage surface 272 of the third interlock link. This allows the bias spring 206 to move the third and fourth interlock links 248 and 258 to the positions shown in FIGS. 18 and 19, wherein the fourth interlock link 258 is elevated to a position where a closing operation of clapper 266 and the fourth interlock link 258 will result in no engagement between end 262 of the fourth interlock link and tab 178, preventing the initiation of a close operation. Arrow 273 indicates that end 262 will clear the upper end of tab 178 when interlock link 258 is in the elevated position shown in FIGS. 18 and 19.

Should circuit breaker 30 assume a condition which permits it to be closed while the fourth interlock link 258 is raised, i.e., in the position shown in FIGS. 18 and 19, it will not jam or hang-up circuit breaker 30, even if a closing operation is initiated while the fourth interlock link 258 is moving downwardly, due to the generous dimensioning of tab 178 which causes end 262 to strike the operating surface of tab 178 during such as situation.

Figure 20:
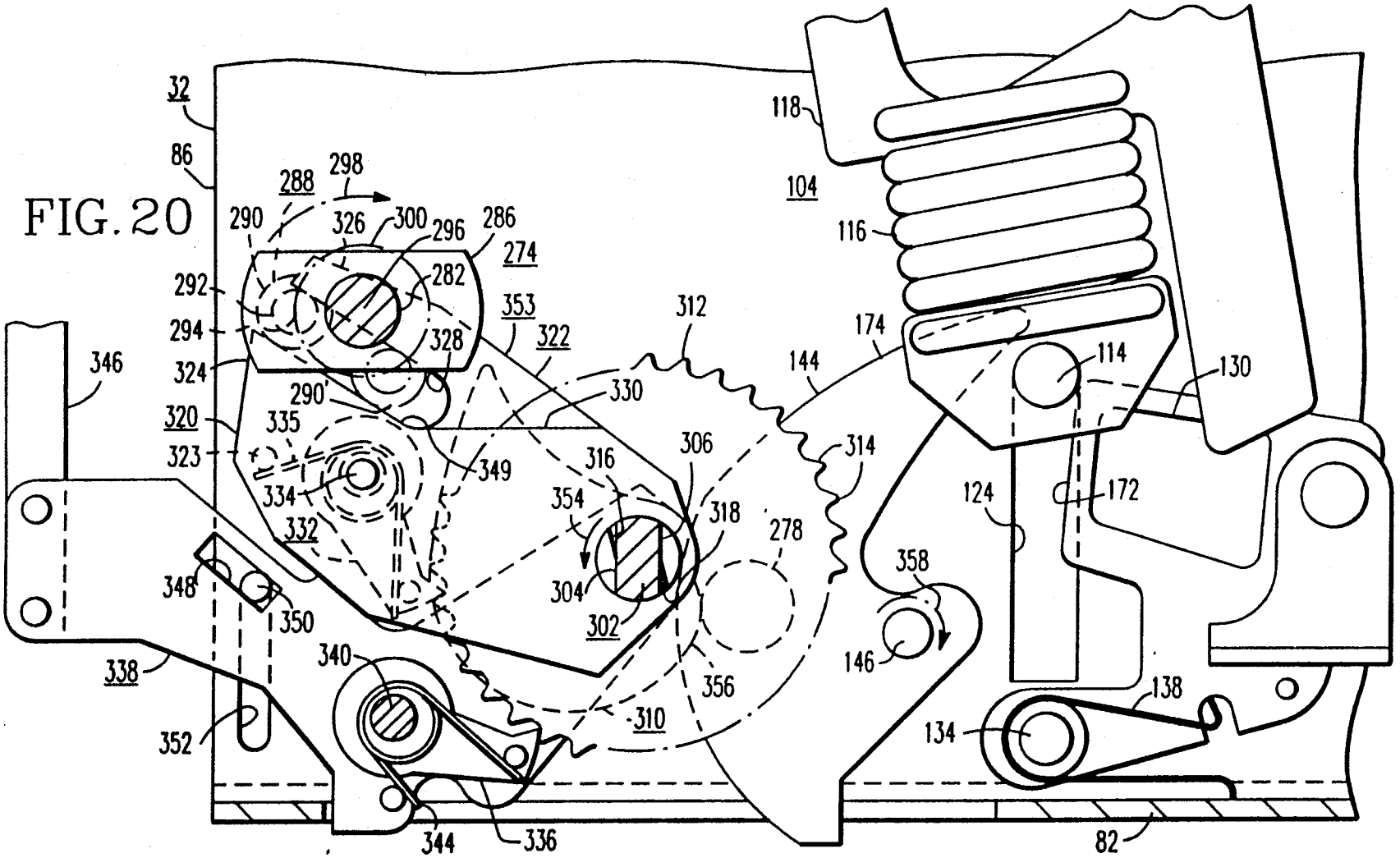
FIG. 20 is a side elevational view of a power operated charging mechanism for charging the closing spring, constructed according to the teachings of the invention, which may be used instead of the manual charging arrangement shown in FIG. 1, with the power operated charging mechanism being shown just prior to charging of the closing spring.
Figure 21:
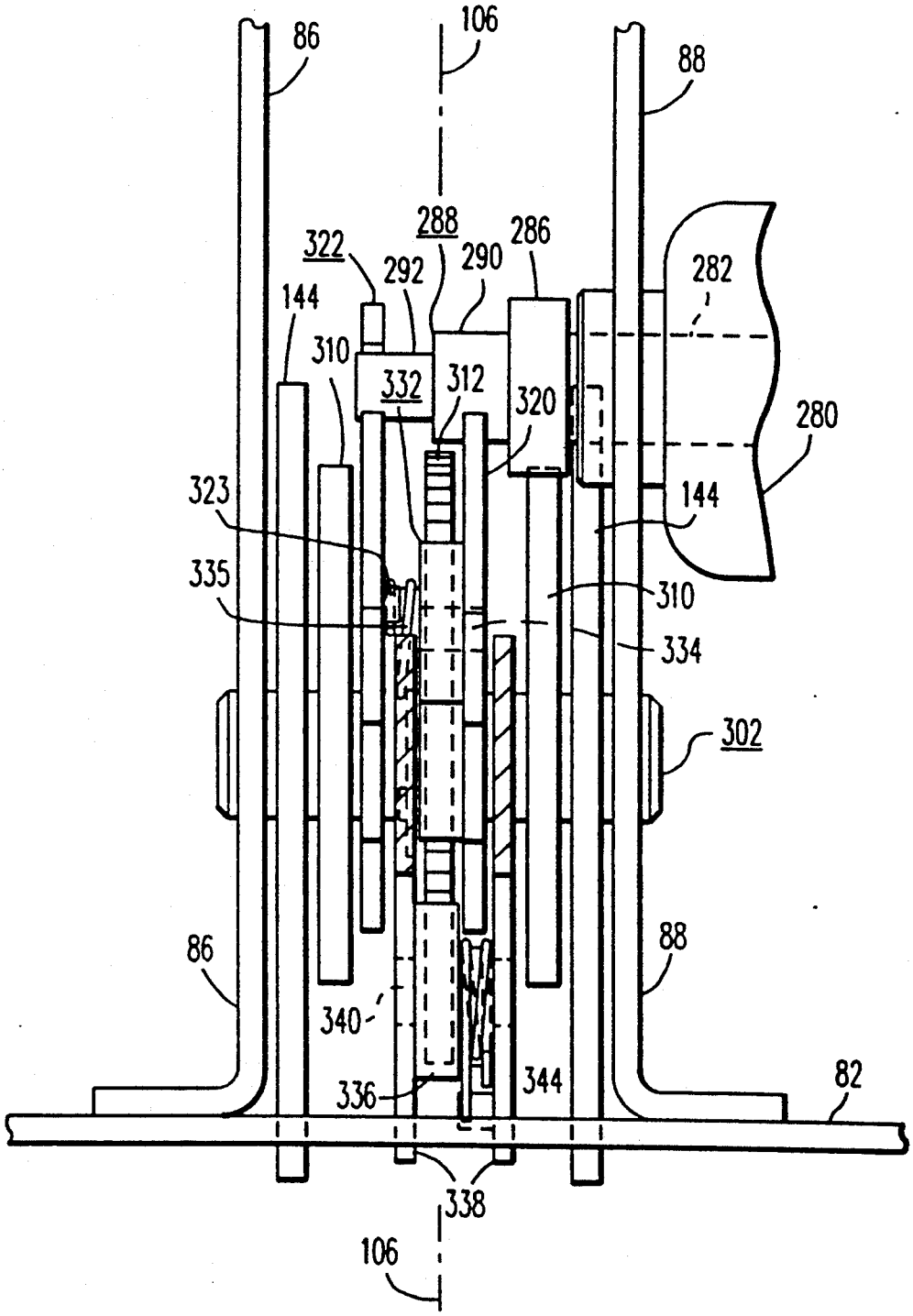
FIG. 21 is an elevational end view of the power operated charging mechanism shown in FIG. 20.
Figure 22:
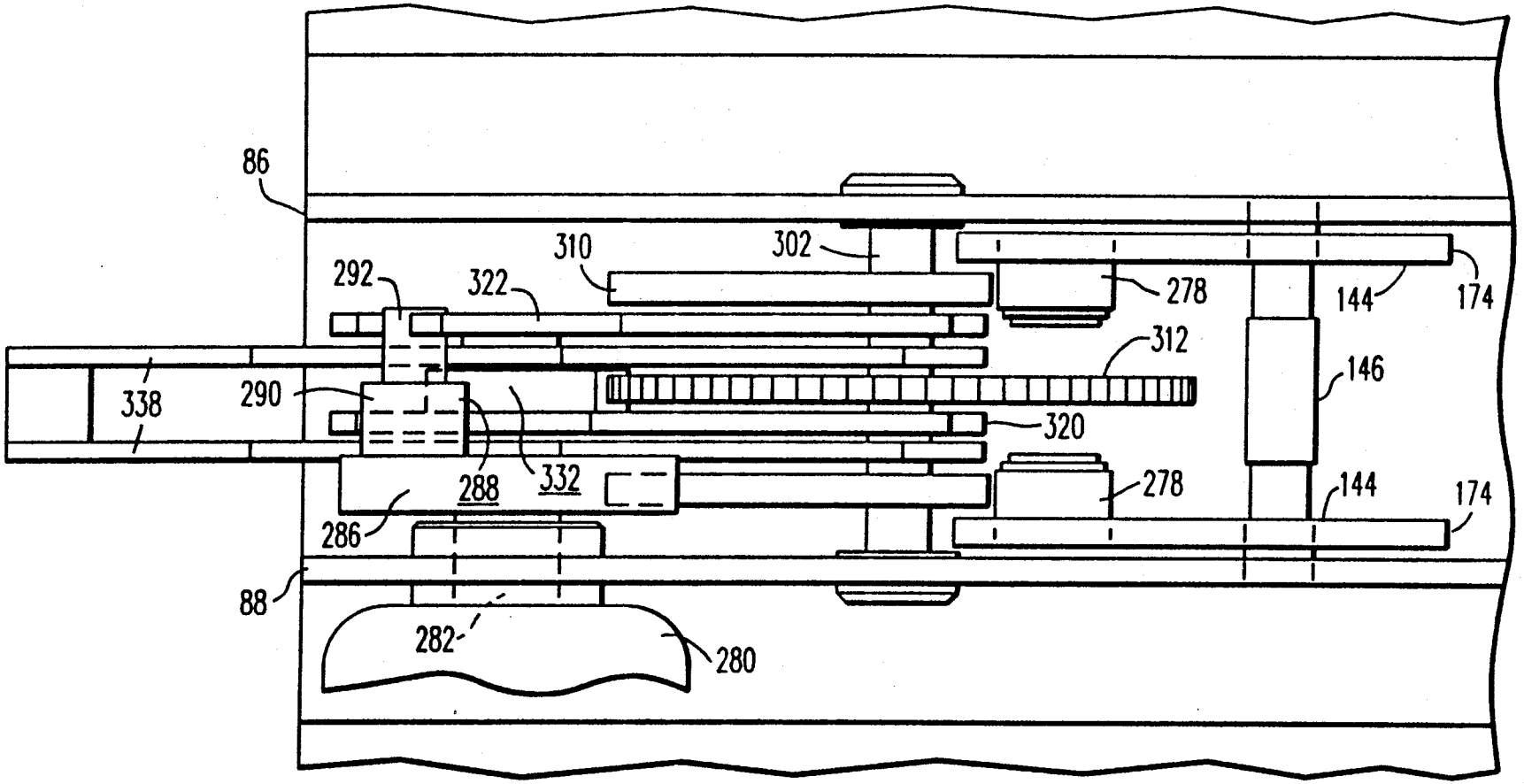
FIG. 22 is a plan view of the power operated charging mechanism shown in FIG. 20.
Figure 23:
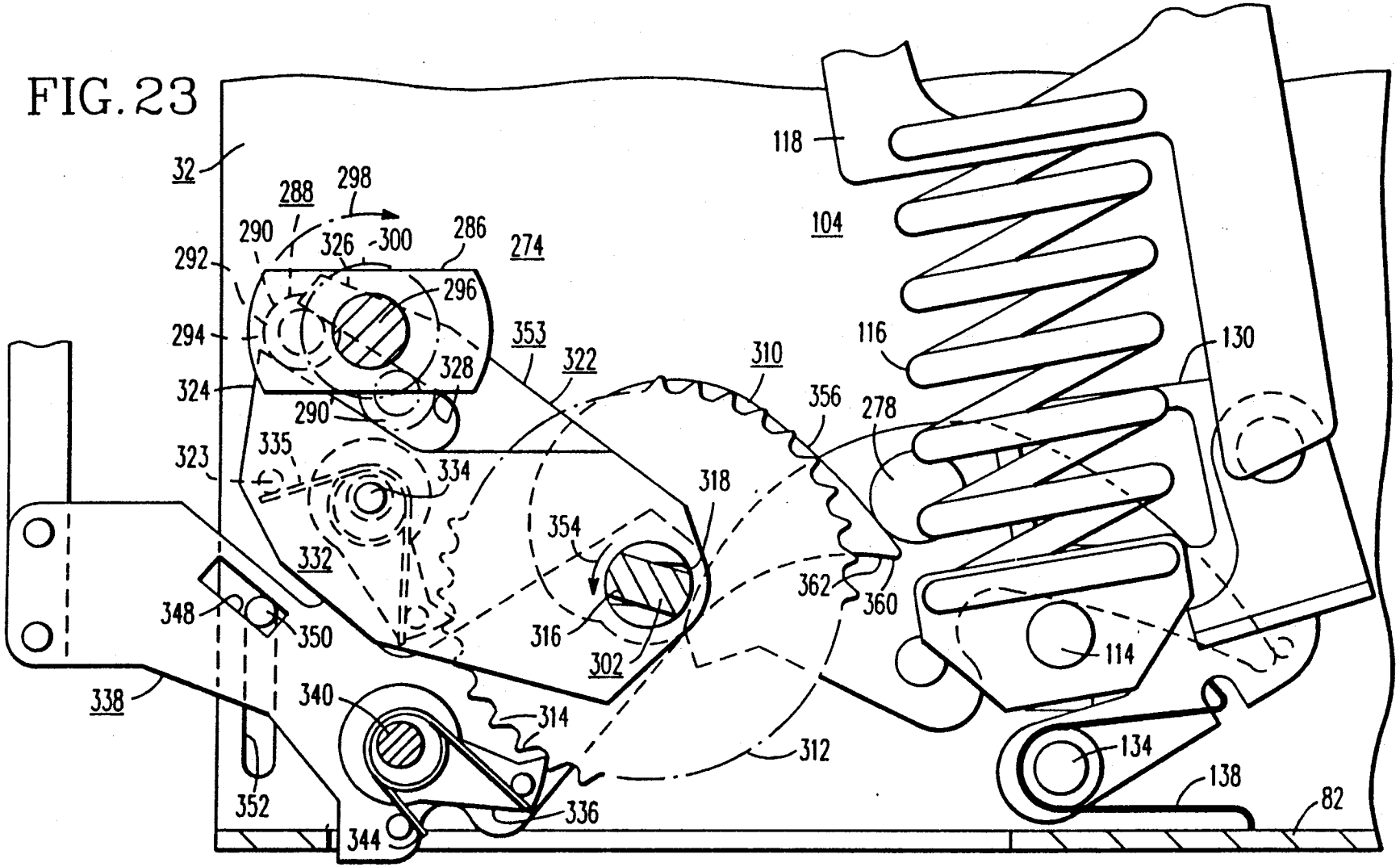
FIG. 23 is an elevational view of the power operated charging mechanism shown in FIG. 20, except illustrating the configuration of the power operated arrangement with the closing spring fully charged and ready to be transferred to a lower hook.

Circuit breaker 30 has been described up to this point with a manually operated charging mechanism, which includes handle arrangement 148, for the charging of the closing spring 116. Circuit breaker 30 has the option of being provided with an electrical or power operated charging apparatus or mechanism 274 constructed according to the teachings of the invention, as set forth in FIGS. 20 through 23. FIG. 20 is a side elevational view of the power operated charging mechanism 274 in a position to charge a reset closing spring assembly 104, and FIGS. 21 and 22 are end elevational and plan views, respectively, of the power operated charging mechanism 274 shown in FIG. 20. FIG. 23 is a view similar to that of FIG. 20, except illustrating the power charging mechanism 274 with the closing spring 116 fully charged and at a point where the charged closing spring 116 is being transferred from the charging crank 144 to the second hook means 130. In the power operated charging mechanism 274, an aperture 276 in charging crank 144 is provided With a roller 278, and the manual handle arrangement 148 is replaced with the power operated charging mechanism 274.

More specifically, the power operated charging mechanism 274 includes an electric motor 280 having a shaft 282 which extends through an opening 284 disposed in the second frame member 88. An eccentric 286 is mounted on motor shaft 282, and a shaft member 288 is mounted thereon. Shaft member 288 has first and second cylindrical surfaces 290 and 292, respectively, which define first and second different diameters, with the first diameter being larger than the second. Shaft 282 is mounted on eccentric 282 on a center 294 which is spaced from a center 296 aligned with the longitudinal axis of motor shaft 282. Thus when motor shaft 282 rotates, such as in the clockwise direction indicated by arrow 298, center 294 describes an arc indicted by broken line 300.

A shaft 302 having flat parallel sides 304 and 306 except for its ends, which are round, has the round ends supported for rotation via openings 308 in the first and second frame members 86 and 88. A charging cam 310 having an oblong opening therein having the same configuration as the cross hatched portion of shaft 302 shown in FIG. 20, is mounted on shaft 302 for rotation therewith. A ratchet wheel 312 having a plurality of ratchet teeth 314 uniformly spaced about its periphery is also disposed on shaft 302, for rotation with shaft 302. Ratchet wheel 312 is centrally located, i.e., on centerline 106, with many of the elements of mechanism 274 being repeated on opposite sides of centerline 106, as best shown in the end elevational view of FIG. 21.

In a preferred embodiment of the invention, instead of having an opening in ratchet wheel 312 sized to snugly receive the flat sides 304 and 306 of shaft 302, the ratchet wheel opening includes sides which contact sides 304 and 306 for about one-half of the dimension across a flat portion, and then the ratchet wheel opening includes sides 316 and 318 which angle away from the sides 304 and 306 of shaft 302, as illustrated in FIG. 20. The purpose of this preferred configuration of the opening in ratchet wheel 312 will be hereinafter explained.

Charge and lift levers 320 and 322, respectively, are mounted for rotation in unison on shaft 302, i.e., not for rotation with shaft 302, and thus they have round openings dimensioned to rotate on the curved portions of shaft 302. A pin 323 interconnects levers 320 and 322, causing them to mechanically oscillate in unison, as will be hereinafter described.

Charge and lift levers 320 and 322 have similar configurations except the lift lever 322 has spaced first and second fingers 324 and 326 which define a slot 328, while the charge lever 320, after completing the first finger 324, terminates in a flat side portion 330 without defining the second finger 326 or slot 328. A first pawl 332 is pivotally mounted on the charge lever 320 via a pivot pin 334. A torsion spring 335 biases the first pawl 332 against the teeth 314 of the ratchet wheel 312.

A second pawl 336 and an emergency charge lever 338 are pivotally related via a pivot pin 340. A torsion spring 344 biases the second pawl against the teeth 314 of the ratchet wheel 312. The emergency charge lever 338, which includes a handle 346, has a slot 348. A pin 350 extends through slot 348 in emergency charge lever 338, and pin 350 also extends through a slot 352 disposed in frame member 88. Spring 344, which biases the second pawl 336 counter clockwise, biases emergency charge lever 338 in a clockwise direction. Thus, rotating handle 346 counter clockwise forces pin 350 downwardly in frame slot 352, and towards the left hand side of slot 348 in emergency charge lever 338, forcing the second pawl 336 to the right, when viewing FIG. 20, and advancing the ratchet wheel 312 one tooth.

When it is desired to electrically charge the closing spring 116, motor 280 is energized and it rotates eccentric 286 in a clockwise direction, when viewing FIG. 20, as indicated by arrow 298. In the broken outline position 290' of surface 290 of eccentric 286 shown in FIG. 20, surface 290 of shaft 288 bears on a surface 349 of the first finger 324 of the charge lever 320, forcing charge lever 320 and the first pawl 332 downwardly. The first pawl 332 thus functions as a drive pawl, advancing ratchet wheel 312 one tooth in the counter clockwise direction, indicated by arrow 354, which also advances charging cam 310 in the same direction. The second pawl 336 functions a hold pawl, preventing ratchet wheel from being rotated clockwise when back pressure from the charging closing spring 116 begins to build. When shaft 288 reaches the position shown in FIG. 20 in which the first surface 290 is shown in solid, the smaller diameter second surface 292 engages a surface 351 of the second finger 326 of the lift lever 322, lifting both the lift lever 322 and charge lever 320 back to a starting position. The first pawl 332 is also lifted, with the end of the first pawl 332 which engages the ratchet teeth 314 simply dragging over a tooth and promptly re-engaging another tooth 314 of the ratchet wheel 312.

The power operated charging mechanism 274 thus includes motor 280, a ratchet wheel 312, and means 353 for translating rotation of motor 280 to rotation of ratchet wheel 312 in the form of a mechanical oscillator arrangement. This mechanical oscillator arrangement 353, which includes the charge lever 320 and the lift lever 322, eliminates the need for a costly return spring.

The charging cam 310 has a curved surface 356 which has an increasingly larger radius in engagement with roller 278 of the charging crank 144 as cam 310 steps with ratchet wheel 312 and shaft 302 in a counter clockwise direction. The action of cam 310 against roller 278 causes the charging crank 144 to rotate clockwise about its pivot pin 146, as indicated by arrow 358. Thus, the charging finger portion 174 of charging crank 144 engages shaft 114 and charges the closing spring 116 step by step as ratchet wheel 312 is advanced.

When charging cam 310 reaches an end 360 on the curved surface 356 which has the increasing radii, closing spring 116 will be fully charged, shaft 114 will have passed the end of surface 172 of the second hook means 130, enabling the second hook means 130 to be biased counter clockwise such that the hook portion 142 is in position to support shaft 114. As roller 278 goes past end 360 of the charging cam 310, shaft 114 is abruptly pulled against the hook surface 142 of the second hook means 130 by the force of the charged closing spring 116. While the movement of shaft 114 from the position it was moved to by the charging crank 144, to the support position against surface 142 of the second hook means is very small, such as about 1.5 mm, the large stored force in the closing spring 116 causes roller 278 to hit the charging cam surface 362, just past the cam point 360, applying a shock force to charging cam 310. This shock force, however, is not immediately transferred to the ratchet wheel 312, due to the additional flat surfaces 316 and 318 formed on the opening in the ratchet wheel 312. The charging cam 310 and shaft 302 thus absorb the initial shock force, rotating shaft 302 through the "dead band" created by the additional flats 316 and 318 on the ratchet wheel opening, and then shaft 302 contacts the ratchet wheel. This division of shock forces thus beneficially reduces the shock applied to the ratchet wheel 312 and associated elements.

When the second hook means 130 rotates counter clockwise to the hooking position, a switch 364, shown in FIG. 1, is actuated which de-energizes electric motor 280. In prior art electric charging arrangements of which we are aware, the coasting motor is a problem as it continues to charge the closing spring. Thus, costly expedients are resorted to, such as providing a brake for motor 280. In the present invention, the motor 280 is allowed to coast, with the charging cam 310 continuing to rotate to a point where it again contacts the charging crank 144, forcing it into another clockwise charging movement. This has no affect on the discharged closing spring assembly 104, simply delaying by a few seconds the ability of the reset means 166 to pull the closing spring assembly 104 back to the reset position. Once the charging crank goes through one more additional charging movement and the roller 278 enters the shallow surface 362 of the charging cam 310, the charging crank 144 is free to move counter clockwise as shaft 114 contacts the charging crank finger 174 during reset of the closing spring assembly 104 by the reset means 166. Thus, the disclosed electrical charging arrangement requires no additional means for stopping motor 280 after it is cut off, reducing the cost of the power operated charging mechanism 274. It will also be noted that once the power operated charging mechanism 274 charges the closing spring 116, that the forces of the closing spring 116 are completely borne by the first and second hook means 128 and 130, as in the mechanical charging embodiment. Thus, the power operated charging mechanism 274 does not have to be constructed to withstand the forces of the closing spring 116 for long periods of time, again enabling the cost of the power operated charging mechanism to be reduced.

When closing spring 116 is to be charged by the emergency charge lever 338 and associated handle 346, the first and second pawls 332 and 336 exchange functions. Pulling handle 346 to the left, or counter clockwise, when viewing FIG. 20, causes pawl 336 to become the drive pawl, to advance ratchet wheel 312, as hereinbefore explained, and the first pawl 332 now functions as the hold pawl, preventing clockwise rotation of the ratchet wheel.

We claim:

1. A circuit breaker having an electrical contact movable between open and closed positions, a closing spring assembly comprising a closing spring and first and second spring brackets, charging means for charging the closing spring, discharge means for discharging the closing spring, and translating means for moving the electrical contact from an open to a closed position in response to the discharge of the closing spring, characterized by:

said closing spring assembly, when discharged, occupying one of first and second positions, with the first position being a discharged position which the spring assembly assumes immediately following discharge, and with the second position being a reset position, and including reset means, said reset means moving the closing spring assembly as an integral unit, including the charging spring and the first and second spring brackets, from said discharged position of the closing spring assembly to said reset position of the closing spring assembly, said closing spring assembly being chargeable by the charging means only in said reset position.

2. The circuit breaker of claim 1 wherein the charging means includes:

first hook means having a hook position in which it releasably holds the first spring bracket in the reset position, during and after the charging of the closing spring, and second hook means having a hook position in which it releasably holds the second spring bracket, after the closing spring has been charged, whereby the first and second hook means cooperatively support all forces exerted by the charged closing spring.

3. The circuit breaker of claim 2 wherein the discharge means includes:

first release means for releasing the first hook means from the hook position, to mechanically release the, first spring bracket from the first hook means and discharge the closing spring, and second release means for releasing said second hook means from said hook position, to mechanically release the second spring bracket from the second hook means when the spring assembly is in the discharged position, with the reset means moving the closing spring assembly from the discharged position to the reset position when the closing spring assembly is mechanically released by both the first and second hook means.

4. The circuit breaker of claim 3 wherein the second release means includes means associated with the first spring bracket, wherein predetermined movement of the first spring bracket after it is released initiates the release of the second spring bracket.

5. The circuit breaker of claim 3 wherein the second release means includes an integral extension of the first spring bracket, wherein predetermined movement of the first spring bracket after it is released initiates the release of the second spring bracket.

6. The circuit breaker of claim 3 including interlock means associated with the first release means, said interlock means being responsive to the position of the closing spring assembly, releasing the first hook means from the hook position thereof during movement of the closing spring assembly from the discharged position to the reset position, enabling the reset means to move the closing spring assembly from the discharged position to the reset position without interference.

7. The circuit breaker of claim 6 including shaft means carried by the first spring bracket which is engaged by the first hook means when the closing spring is charged, and including bias means biasing the first hook means towards the hook position thereof, with the shaft means functioning during movement of the spring assembly from the discharged position to the reset position to move the first hook means to a non-interfering position, against the bias of said bias means, until the first spring bracket reaches the reset position of the closing spring assembly and the shaft means is in a position to be engaged by the first hook means.

8. The circuit breaker of claim 2 wherein the closing spring, when charged, is completely supported by the first and second hook means, with the charging means for charging the closing spring being isolated from the forces of the charged closing spring.

9. The circuit breaker of claim 1 wherein the translating means which moves the movable contact to the closed position also maintains the movable contact in the closed position, with the translating means being isolated from the forces of the charged closing spring.

10. The circuit breaker of claim 1 wherein the translating means translates movement of the first spring bracket during discharge of the closing spring to movement of the movable contact to the closed position.

11. The circuit breaker of claim 1 wherein the first spring bracket defines an aperture, and the translating means includes an operating member within the aperture, whereby the translating means translates movement of the first spring bracket during discharge of the closing spring to movement of the movable contact to the closed position.

12. The circuit breaker of claim 11 wherein the aperture is dimensioned to enable the closing spring to be re-charged after the movable contact is in the closed position, permitting movement of the closing spring assembly from the discharged position to the reset position, and re-charging of the closing spring, all without contact between the operating member of the translating means and the portion of the first spring bracket which defines the aperture.

13. The circuit breaker of claim 1 wherein the translating means includes a linkage assembly, and selector means for selectively operating said linkage as a four bar linkage, and as a five bar linkage.

14. The circuit breaker of claim 13 wherein the selector means operates the linkage assembly as a four bar linkage during closure of the circuit breaker, with movement of the first spring bracket, after it is released to initiate discharge of the closing spring, toggling the four bar linkage from a first position to a second position, moving the movable contact to, and maintaining the movable contact in, the closed position.

15. The circuit breaker of claim 13 wherein the selector means operates the linkage assembly as a four bar linkage during closure of the circuit breaker, and wherein the linkage assembly includes a plurality of link members pivotally interconnected via pivot pins, with a predetermined one of the pivot pins including an extended portion, and wherein the first spring bracket defines an aperture, with the extended portion of the predetermined pivot pin being disposed within the aperture, whereby movement of the first spring bracket, after it is released to initiate discharge of the closing spring, drives said predetermined pivot pin from a first position to a second position, toggling the four bar linkage from a first configuration to an over-center second configuration, moving the movable contact to, and maintaining the movable contact in, the closed position.

16. The circuit breaker of claim 13 wherein the selector means operates the linkage assembly as a four bar linkage during closure of the circuit breaker, and including trip means for tripping the circuit breaker, with said selector means being responsive to said trip means, converting the four bar linkage to a five bar linkage which releases the movable contact from the closed position.

17. The circuit breaker of claim 16 including opening spring means which stores energy when the movable contact is moved to the closed position, with the opening spring means releasing and transferring the stored energy to the movable contact, in response to the four bar linkage being converted to a five bar linkage, to propel the movable contact away from the closed position.

18. The circuit breaker of claim 2 wherein the second spring bracket includes a shaft member, and the closing spring charging means includes a charging crank member which engages the shaft member of the second spring bracket during the charging of the closing spring, and including means for rotating the charging crank member to charge the closing spring, and means responsive to the closing spring reaching the charged position for causing the second hook means to move to the hook position thereof, permitting disengagement of the charging crank member from the shaft member.

19. The circuit breaker of claim 18 wherein the means responsive to the closing spring reaching the charged position includes bias means biasing the second hook means towards the hook position thereof, and a predetermined restraining portion of the second hook means which terminates at a hook portion of the second hook means, with said predetermined restraining portion of the second hook means contacting the shaft member of the second spring bracket, at least during the charging of the closing spring, with said shaft member moving the second hook means against the bias of said bias means, away from the hook position of the second hook means, until the shaft member reaches the hook portion of the second hook means, whereupon the bias means moves the second hook means to the hook position thereof.

20. The circuit breaker of claim 18 wherein the means for rotating the charging crank member to charge the closing spring includes an electric motor, a ratchet wheel, means for translating rotation of the electric motor to rotation of the ratchet wheel, a charging cam which rotates with the ratchet wheel and engages the charging crank during a predetermined angular rotation of the charging cam, to rotate the charging crank and charge the closing spring, and means for de-energizing the electric motor when the closing spring is charged, whereby the coasting electric motor continues to rotate the ratchet wheel and charging cam, and the reset means includes bias means which continuously biases the closing spring assembly towards the reset position, whereby the reset means functions to return the discharged closing spring assembly to the reset position, notwithstanding that the coasting electric motor, ratchet wheel and charging cam may momentarily force the charging crank into an interfering position, with the reset means functioning when the charging crank is not constrained by the charging cam.

21. The circuit breaker of claim 18 wherein the means for rotating the charging crank member to charge the closing spring includes an electric motor, a ratchet wheel, means for translating rotation of the electric motor to rotation of the ratchet wheel, a ratchet shaft, said ratchet wheel being mounted on said ratchet shaft such that rotation of the ratchet wheel rotates the ratchet shaft, a charging cam on the ratchet shaft which rotates with the ratchet shaft and engages the charging crank during a predetermined angular rotation of the charging cam, to rotate the charging crank and charge the closing spring, said ratchet wheel being mounted on said ratchet shaft to provide a predetermined relative rotational movement between the ratchet shaft and ratchet wheel before engagement, whereby shock forces, which may be applied to the charging cam by the charging crank as the charged closing spring is transferred from the charging crank to the second hook means, are divided between the charging cam and ratchet wheel, being first applied to the charging cam and ratchet shaft, and then after said predetermined rotational movement of the ratchet shaft, to the ratchet wheel.

22. The circuit breaker of claim 18 wherein the means for rotating the charging crank member to charge the closing spring includes an electric motor, a ratchet wheel, a ratchet shaft, mechanical oscillator means for translating rotation of the electric motor to stepped rotation of the ratchet wheel, and means for translating rotation of the ratchet wheel to rotation of the charging crank member, with the mechanical oscillator means including an eccentric mounted for rotation by the electric motor, a shaft on the eccentric having first and second surfaces which define first and second different diameters, first and second levers mounted for rotation on the ratchet shaft, means for causing said first and second levers to rotate together, a pawl mounted for rotation on the first lever, means biasing said pawl against the ratchet wheel, said first and second levers each having a predetermined surface which is contacted by the first and second surfaces, respectively, of the shaft mounted on the eccentric, during each revolution of the eccentric, whereby movement of the first surface against the predetermined surface of the first lever moves the first and second levers and the first pawl from a first position to a second position, to advance the ratchet wheel, and movement of the second surface against the predetermined surface of the second lever moves the first and second levers and first pawl back to the first position.

23. The circuit breaker of claim 18 wherein the means for rotating the charging crank member to charge the closing spring includes a ratchet wheel, first and second pawls biased against the ratchet wheel, and means for translating rotation of the ratchet wheel to rotation of the charging crank member, first means including an electric motor for rotating the ratchet wheel in a predetermined direction, with the first pawl being responsive to the first means for advancing the ratchet wheel, and wherein the second pawl functions to prevent rotation of the ratchet wheel in a direction opposite to said predetermined direction, and second means including a manually operated lever for rotating the ratchet wheel in said predetermined direction, with the second pawl being responsive to the second means for advancing the ratchet wheel, and wherein the first pawl functions to prevent rotation of the ratchet wheel in a direction opposite to said predetermined direction.

24. The circuit breaker of claim 3 including interlock means which logically relates the condition of the charging spring and the position of the movable electrical contact, enabling the first release means to release the first hook means only when the closing spring is charged and the movable electric contact is in the open position.

25. The circuit breaker of claim 24 wherein the first spring bracket defines an aperture, and the translating means includes an operating member within the aperture, whereby the translating means translates movement of the first spring bracket and operating member from a first position to a second position, during discharge of the closing spring, to movement of the movable electrical contact to the closed position, and wherein the interlock means is responsive the position of the operating member and the position of the second hook means, enabling operation of the first release means only when the operating member is in the first position and the second hook means is in the hook position.

26. The circuit breaker of claim 25 wherein the aperture is dimensioned to enable the closing spring to be re-charged after the movable contact is in the closed position, permitting movement of the closing spring assembly from the discharged position to the reset position, and re-charging of the closing spring, all without contact between operating member of the translating means and the portion of the first spring bracket which defines the aperture.

27. A circuit breaker having an electrical contact movable between open and closed positions, a closing spring, charging means for charging the closing spring, discharge means for discharging the closing spring, and translating means for moving the electrical contact from the open position to the closed position in response to discharge of the closing spring, characterized by:

the translating means including a linkage assembly, and selector means for selectively operating said linkage assembly as a four bar linkage, and as a five bar linkage.

28. The circuit breaker of claim 27 wherein the selector means operates the linkage assembly as a four bar linkage during closure of the circuit breaker, with the four bar linkage being toggled from a first position to a second position, moving the movable electrical contact to, and maintaining the movable contact in, the closed position, in response to discharge of the closing spring.

29. The circuit breaker of claim 27 wherein the selector means operates the linkage assembly as a four bar linkage during closure of the circuit breaker, and wherein the linkage assembly includes a plurality of link members pivotally interconnected via pivot pins, with a predetermined one of the pivot pins including an extended portion, with the extended portion of the predetermined pivot pin being responsive to discharge of the closing spring, toggling the four bar linkage from a first configuration to an over-center second configuration, to move the movable contact to, and to maintain the movable electrical contact in, the closed position.

30. The circuit breaker of claim 27 wherein the selector means operates the linkage assembly as a four bar linkage during closure of the circuit breaker, and including trip means for tripping the circuit breaker, with said selector means being responsive to said trip means, converting the four bar linkage to a five bar linkage which releases the movable contact from the closed position.

31. The circuit breaker of claim 30 including opening spring means which stores energy when the movable contact moves to the closed position, with the opening spring means releasing and transferring the stored energy to the movable contact, in response to the four bar linkage being converted to a five bar linkage, to propel the movable contact away from the closed position.

32. The circuit breaker of claim 27 wherein the linkage assembly includes first, second, third, and fourth links each having first and second ends, and a support base, first pivot means pivotally connecting the second end of the first link to the first end of the second link, second pivot means pivotally connecting the second end of the second link to the first end of the third link, third pivot means pivotally connecting the second end of the third link to the first end of the fourth link, and means pivotally fixing the first end of the first link and the second end of the fourth link to the support base, whereby the support base functions as a fifth link, with the electrical contact being attached to said fourth link, and including trip means which includes prop means for releasably restraining the first pivot means in a first predetermined location until it is desired to trip the circuit breaker, with said prop means, while restraining the first pivot means, converting the five bar linkage to a four bar linkage, whereby movement of the second pivot means, when the electrical contact is in the open position, moves the fourth link and the associated electrical contact from the open position to the closed position, in which the four bar linkage goes over center, and including opening spring means which is charged as the four bar linkage goes over center, to hold the four bar linkage in the over center position.

33. The circuit breaker of claim 32 wherein removal of the restraint on the first pivot means by the prop means enables the opening spring means to force the fourth link about its fixed pivot, collapsing the first and second links about the unrestrained first pivot means.

34. A circuit breaker having an electrical contact movable between open and closed positions, a closing spring, charging means for charging the closing spring including a charging crank, an electric motor, a ratchet wheel, means for translating rotation of the electric motor to rotation of the ratchet wheel, and a ratchet shaft, with said ratchet wheel being mounted on said ratchet shaft such that rotation of the ratchet wheel rotates the ratchet shaft, discharge means for discharging the closing spring, and translating means for moving the electrical contact from the open position to the closed position in response to the discharge of the closing spring, characterized by:

a charging cam on the ratchet shaft which rotates with the ratchet shaft and engages the charging crank during a predetermined angular rotation of the charging cam, to rotate the charging crank and charge the closing spring, and hook means which receives and supports the closing spring after the closing spring is charged by the charging crank, said ratchet wheel being mounted on said ratchet shaft to provide a predetermined relative rotational movement between the ratchet shaft and ratchet wheel before engagement, whereby shock forces which may be applied to the charging cam by the charging crank as the charging spring is transferred from the charging crank to the hook means are divided between the charging cam and ratchet wheel, being first applied to the charging cam and ratchet shaft, and then after said predetermined rotational movement of the ratchet shaft, to the ratchet wheel.

35. A circuit breaker having an electrical contact movable between open and closed positions, a closing spring, charging means for charging the closing spring including an electric motor, a ratchet wheel, a ratchet shaft, mechanical oscillator means for translating rotation of the electric motor to rotation of the ratchet wheel, and means for translating rotation of the ratchet wheel to charging of the closing spring, discharge means for discharging the closing spring, and translating means for moving the electrical contact from the open position to the closed position in response to the discharge of the closing spring, characterized by:

said mechanical oscillator means including an eccentric mounted for rotation by the electric motor, a shaft mounted off-center on the eccentric, with said shaft having first and second surfaces, first and second levers mounted for independent rotation on the ratchet shaft, means for causing said first and second levers to move together, a pawl mounted for rotation on the first lever, means biasing said pawl against the ratchet wheel, said first and second levers each having a predetermined surface which is contacted by the first and second surfaces, respectively, of the shaft mounted on the eccentric, during each revolution of the eccentric, whereby movement of the first surface against the predetermined surface of the first lever moves the first and second levers and the first pawl from a first position to a second position, to advance the ratchet wheel, and movement of the second surface against the predetermined surface of the second lever moves the first and second levers and first pawl back to the first position.

36. A circuit breaker having an electrical contact movable between open and closed positions, a closing spring, charging means for charging the closing spring including a ratchet wheel, first and second pawls biased against the ratchet wheel, and means for translating rotation of the ratchet wheel to rotation of the charging crank, first means including an electric motor for rotating the ratchet wheel in a predetermined direction, with the first pawl being responsive to the first means for advancing the ratchet wheel, and wherein the second pawl functions to prevent rotation of the ratchet wheel in a direction opposite to said predetermined direction, and second means, including a manually operated lever, for rotating the ratchet wheel in said predetermined direction, discharge means for discharging the closing spring, and translating means for moving the electrical contact from the open position to the closed position in response to the discharge of the closing spring; characterized by:

the second pawl being responsive to the second means for advancing the ratchet wheel, and wherein the first pawl functions to prevent rotation of the ratchet wheel in a direction opposite to said predetermined direction when the second pawl is functioning to advance the ratchet wheel.

37. A method of operating a circuit breaker having an operating mechanism which includes a closing spring assembly comprising a closing spring and first and second spring brackets, charging means for charging the closing spring, and discharge means for discharging the closing spring to close electrical contacts of the circuit breaker, characterized by the steps of:

holding the first spring bracket, charging the closing spring by the step of moving the second spring bracket, holding the second spring bracket following the charging step, discharging the closing spring by the step of releasing the first spring bracket, to close the electrical contacts of the circuit breaker, releasing the second spring bracket following the step of discharging the closing spring, moving the completely released closing spring assembly as an integral assembly to a reset position, and repeating the steps of holding the first spring bracket, charging the closing spring, and holding the second spring bracket, to enable the circuit breaker to be closed, when desired, immediately following a trip of the circuit breaker.

38. The method of claim 37 wherein the step of moving the closing spring assembly includes the steps of:

biasing the closing spring assembly to the reset position, and guiding the second spring bracket during the biasing step.

39. The method of claim 37 wherein the step of discharging the closing spring to close electrical contacts of the circuit breaker includes the steps of operating a four bar linkage.

40. The method of claim 39 including the step of tripping the circuit breaker to open the electrical contacts, with said tripping step including the step of converting the four bar linkage to a five bar linkage.

41. The method of claim 37 wherein the step of discharging the closing spring to close the electrical contacts of the circuit breaker includes the steps of providing an aperture in the first spring bracket, providing a linkage assembly operable as a four bar linkage, disposing means for operating the linkage assembly in the aperture, and pivoting the linkage assembly via the aperture in response to release of the first spring bracket.

42. The method of claim 41 including the step of dimensioning the aperture to enable the step of moving the spring assembly to a reset position, following the step of discharging the closing spring, without disturbing the closed contacts of the circuit breaker, tripping the circuit breaker, with the tripping step including the step of converting the linkage assembly to a five bar linkage, and repeating the steps of holding the first spring bracket, charging the closing spring, and holding the second spring bracket, to enable the circuit breaker to be closed, when desired, immediately following a trip of the circuit breaker.

* * * * *